US008302340B1

(12) United States Patent
Irwin

(10) Patent No.: US 8,302,340 B1
(45) Date of Patent: Nov. 6, 2012

(54) BOLT ACTION FOR A FIREARM

(76) Inventor: Michael B. Irwin, Bagdad, KY (US)

( * ) Notice: Subject to any disclaimer, the term of this patent is extended or adjusted under 35 U.S.C. 154(b) by 76 days.

(21) Appl. No.: 12/781,251

(22) Filed: May 17, 2010

Related U.S. Application Data

(60) Provisional application No. 61/178,850, filed on May 15, 2009.

(51) Int. Cl.
*F41A 3/14* (2006.01)

(52) U.S. Cl. ..... 42/16

(58) Field of Classification Search ..... 42/16, 2, 42/14

See application file for complete search history.

(56) References Cited

U.S. PATENT DOCUMENTS 1,331,154 A * 2/1920 Johnson ..... 42/16
3,005,279 A * 10/1961 Brewer ..... 42/18
3,253,362 A * 5/1966 Gitchell ..... 42/16
4,653,210 A * 3/1987 Poff, Jr. ..... 42/16
4,930,238 A * 6/1990 Poff, Jr. ..... 42/16
5,259,137 A * 11/1993 Blenk et al. ..... 42/16
5,718,073 A * 2/1998 Sachse et al. ..... 42/51
6,189,253 B1 * 2/2001 Knight et al. ..... 42/51
6,209,249 B1 * 4/2001 Borden ..... 42/16
6,508,025 B1 * 1/2003 Du Plessis ..... 42/16
2010/0175290 A1 * 7/2010 Duplessis et al. ..... 42/16

* cited by examiner

*Primary Examiner* — Bret Hayes
(74) *Attorney, Agent, or Firm* — Middleton Reutlinger; Alexander P. Brackett

(57) ABSTRACT

A bolt action for a firearm includes a receiver body having forward and rear apertures connected by a central bore therethrough, and having a plurality of forward and rear conical seat surfaces proximate the forward and rear apertures. The bolt action further includes a generally cylindrical bolt body having forward and rear ends, a plurality of locking lugs disposed on a forward end thereof for engaging the forward conical surfaces of the receiver body and a floating bolt handle for engaging the rear conical surfaces of the receiver body when the bolt handle is rotated.

13 Claims, 32 Drawing Sheets

BOLT ACTION FOR A FIREARM

CROSS-REFERENCE TO RELATED APPLICATIONS

This application claims priority to and benefit under 35 U.S.C. §119(e) to U.S. Provisional Application Ser. No. 61/178,850, filed on May 15, 2009. The entire contents of the aforementioned application are hereby incorporated by reference.

BACKGROUND OF THE INVENTION

1. Field of the Invention

The present invention relates generally a bolt action for a firearm and more particularly to a receiver body and concomitant bolt body that facilitates the precise positioning of the bolt and firing pin within the receiver by use of forward and rear conical seating surfaces and an improved cocking piece eliminating rear bolt lift induced by angled sear engagements. The present invention further improves the ability of said receiver body to minimize undesirable vibrations during firing by producing a stronger bond between the receiver body and a firearm stock by utilizing angular spaced action screws. Furthermore, the invention provides a receiver that is superior at absorbing recoil energy with horizontally in line recoil lug surfaces.

2. Description of the Related Art

A wide variety of bolt actions for firearms have been practiced since the invention of the bolt action rifle. Prior art bolt actions have as one paramount object the precise perpendicularity of a bolt face to a cartridge chamber, thereby properly positioning a firing pin carried and actuated by the action to strike the primer of a cartridge. Furthermore, by providing precise positioning of the bolt, pressure by the firing pin spring is uniformly dispersed to front locking lugs of the bolt. To provide for precise and repeatable results in firing, it is desirable to secure proper positioning of the bolt in its proper position, relatively immovable with respect to the cartridge and barrel of the firearm during firing pin movement and striking of the cartridge primer.

Due to the inherent nature of modern high-powered rifles the bolt mechanism is subjected to enormous stress under firing conditions as the gas pressure caused by a cartridge firing builds rapidly and expels a projectile from the barrel. Furthermore, in order to achieve precise accuracy during firing it is essentially that the axis of the bolt, and thus the axis of the firing pin, be concentric with the axis of the bore of a firearm barrel, also thereby providing a perpendicular surface to accept a cartridge head. In order to repeat this accurate performance the concentricity of these components must be repeatable each time the bolt is closed.

Many prior art actions utilize sear override trigger systems, which have an inherent flaw where bolt concentricity is concerned. The angled face of the sear contacts the cocking piece face, causing the cocking piece to ride up the sear face when under pressure from the firing pin spring. This in turn forces the rear of the bolt to rise and the top locking lugs at the front of the bolt to be forced slightly forward, which of course prevents proper alignment of the bolt within the action. Generally speaking, the spring pressure at the bottom of the bolt forces unequal pressure of the locking lugs in their seats, thus preventing precise concentric alignment of the bolt and consistent front locking lug pressure.

Additionally, modern rifle target shooters "tune" their rifles to minimize the effect of accuracy-robbing vibrations. These vibrations occur in part from bolt movement once the firing pin spring is actuated, since for most prior art actions at that point the rear of the bolt is capable of some movement with respect to the action. Thus some harmonic vibrations can be attributed to the play between the bolt and the receiver, thereby decreasing accuracy of the firearm.

Producing the correct union between the receiver body and the firearm stock is one method to obviate undesirable vibrations and prevent potential movement of the receiver body in the firearm stock. Prior art bolt actions utilize two to three action screws to secure the receiver body (with attached barrel) to the firearm stock. To aid barrel accuracy, modern rifle target shooters will "float" the barrel, thus eliminating any contact between the barrel and the firearm stock. Thus the full weight of the receiver body and barrel is applied to the joining surfaces of the receiver body in the firearm stock, fastened in place by the aforementioned action screws. To strengthen this union, thereby minimizing vibrations and preventing the receiver body from shifting inside the firearm stock, epoxy based "bedding" is used. In some instances in order to maximize results the bedding process permanently attaches the receiver to the firearm stock.

Additionally, many prior art bolt actions utilize a recoil lug positioned proximate the lowest or bottom-most point of the receiver body to absorb recoil energy generated during firing. Locating recoil lug surfaces only at the very bottom of the receiver body allows recoil energy generated at the barrel's bore to be transferred in an upwards direction, applying additional stress on the union of the receiver body and firearm stock and creating additional harmonic vibrations.

Another accepted technique for maximizing accuracy is the use of small firing pin tips, which tend to yield better ignition while minimizing spring pressure required to actuate the pin. Reduced spring pressure facilitates easy bolt lift and closure and creates reduced vibration as well. However, tight tolerances required for a conventional single-piece firing pin riding inside the bolt body can be difficult and costly to produce. Additionally, the problem of rear bolt lift, particularly caused by angled sear surfaces, can cause the firing pin to flex or bind as it is forced forward during firing, inducing bending or even breaking smaller diameter tips. Some prior art bolt actions utilize floating firing pin tips which allow inadvertent contact with the cartridge primer before actual discharge of the firearm and can allow metal to metal impact during discharging the firearm, creating the possibility of additional undesirable vibrations.

Accordingly, a need exists for a bolt action for a firearm that minimizes or eliminates the aforementioned problems while providing for consistent, reproducible, and accurate firing under all conditions.

BRIEF DESCRIPTION OF THE DRAWING FIGURES

Figure 16:
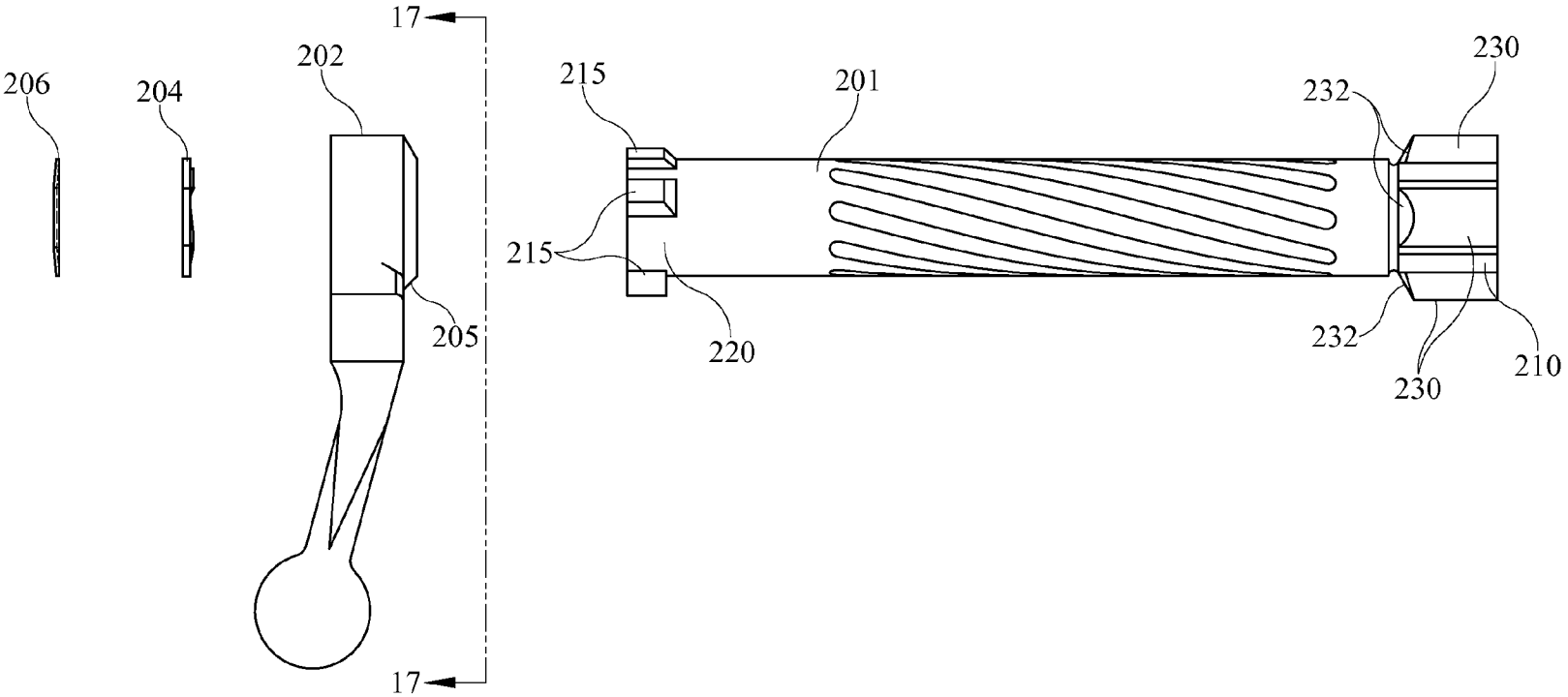
Figure 17:
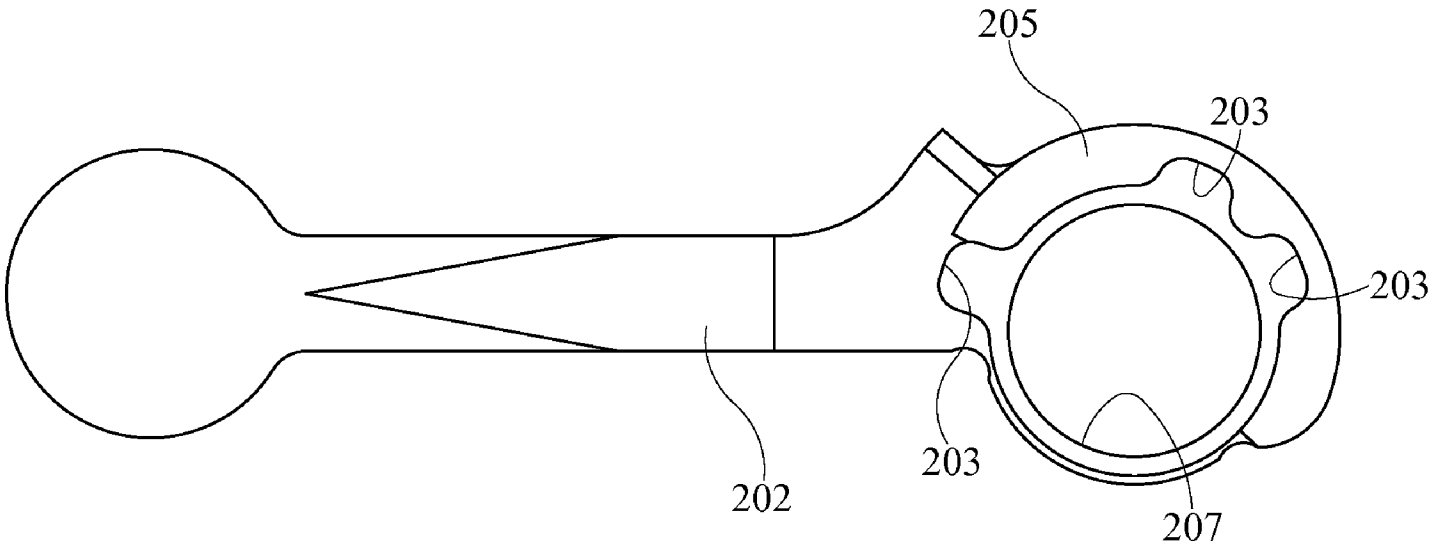
Figure 18:
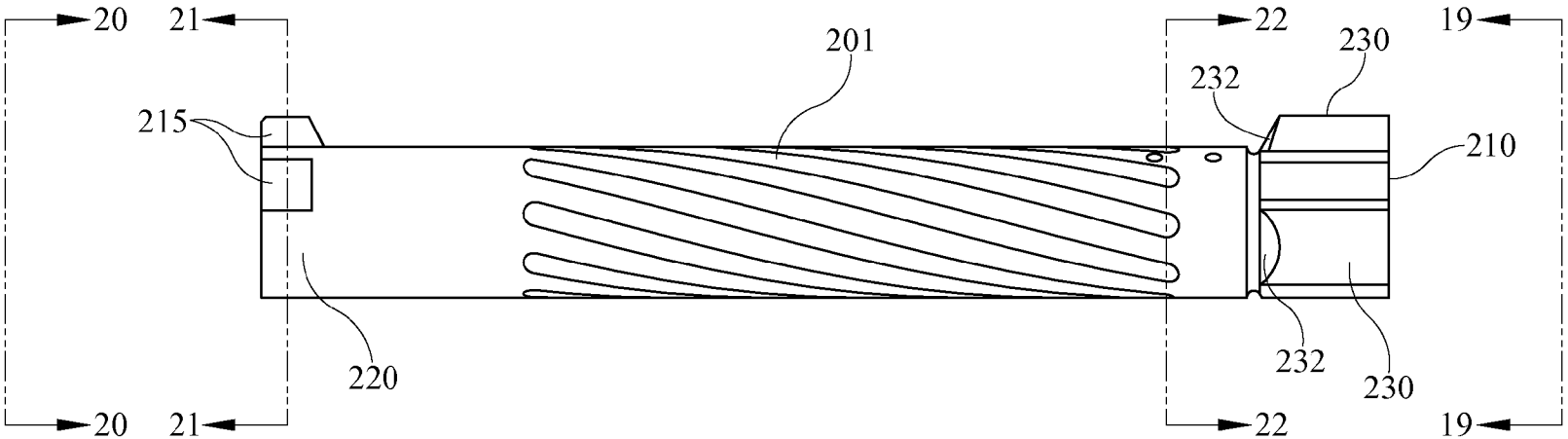
Figure 19:
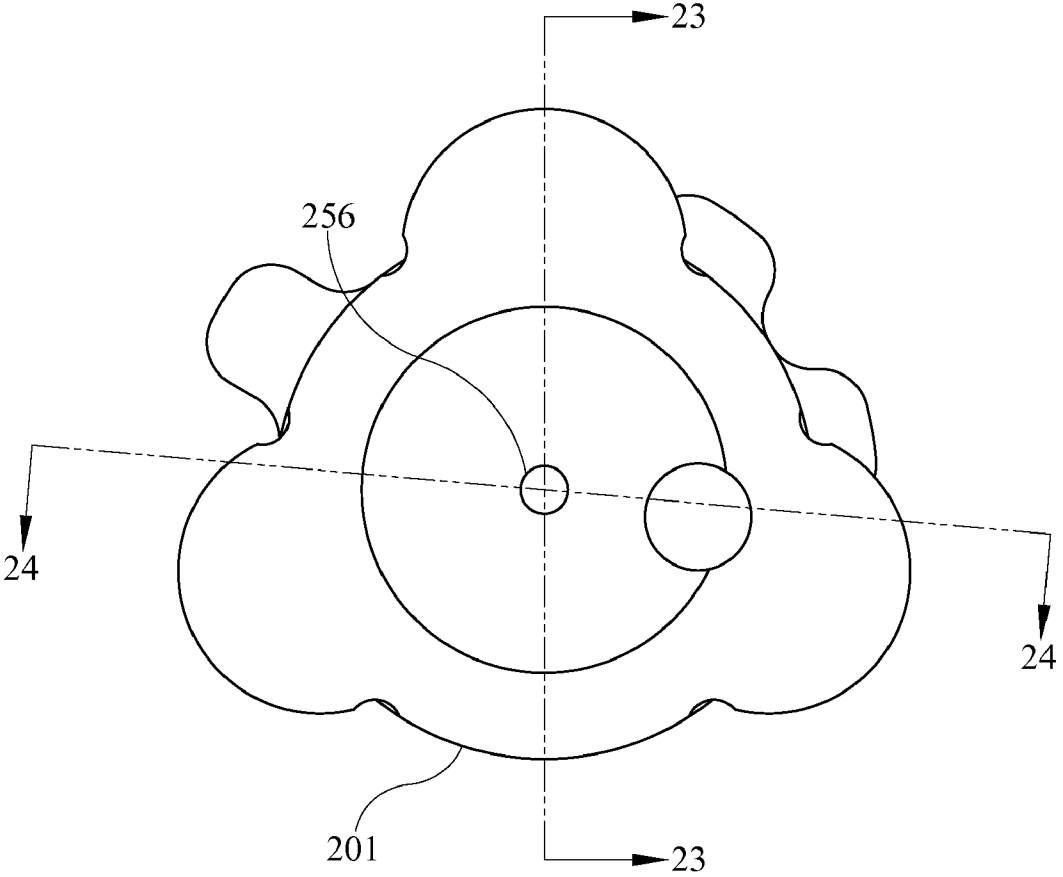
Figure 20:
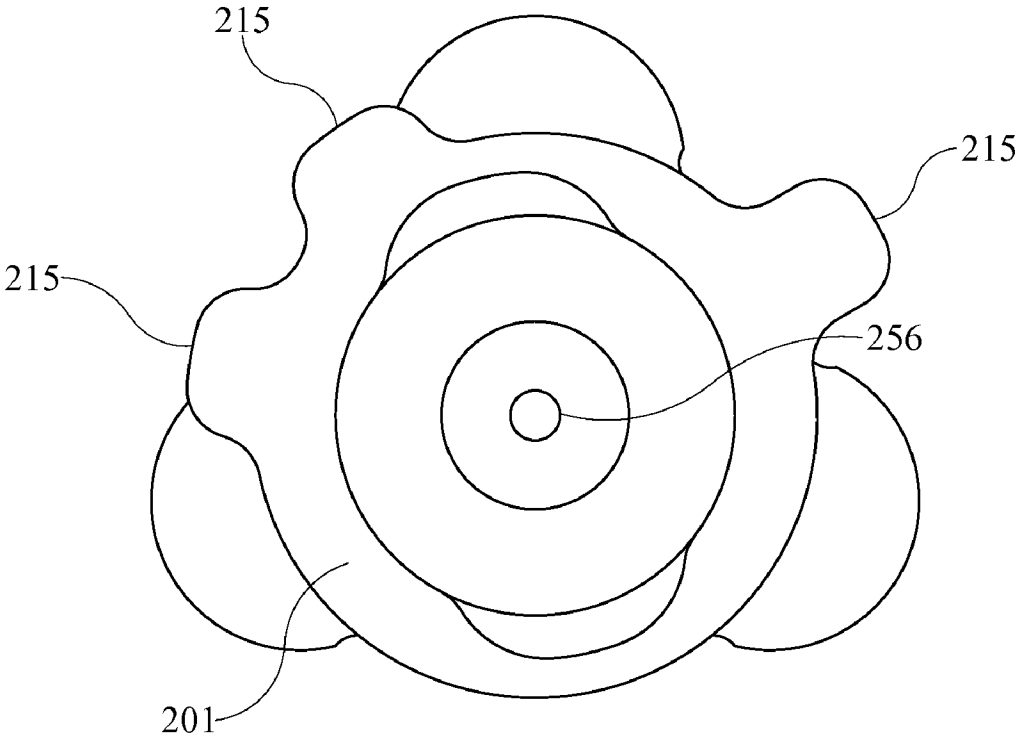
Figure 21:
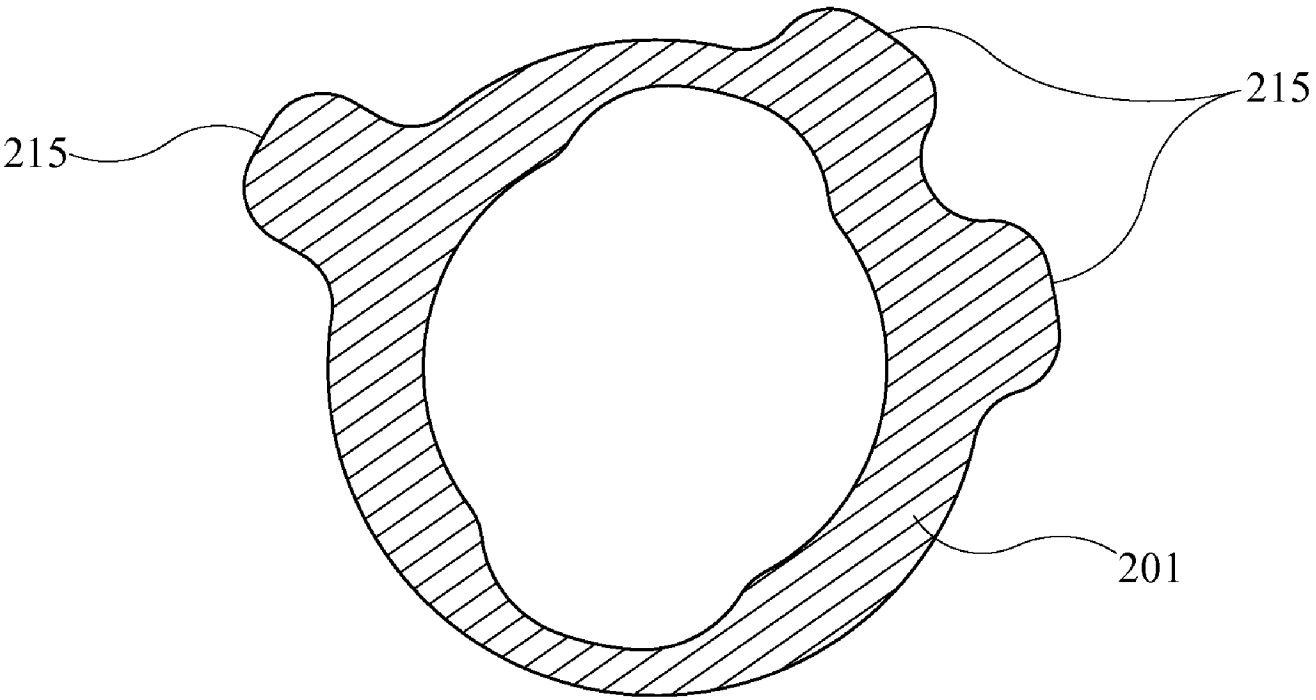
Figure 22:
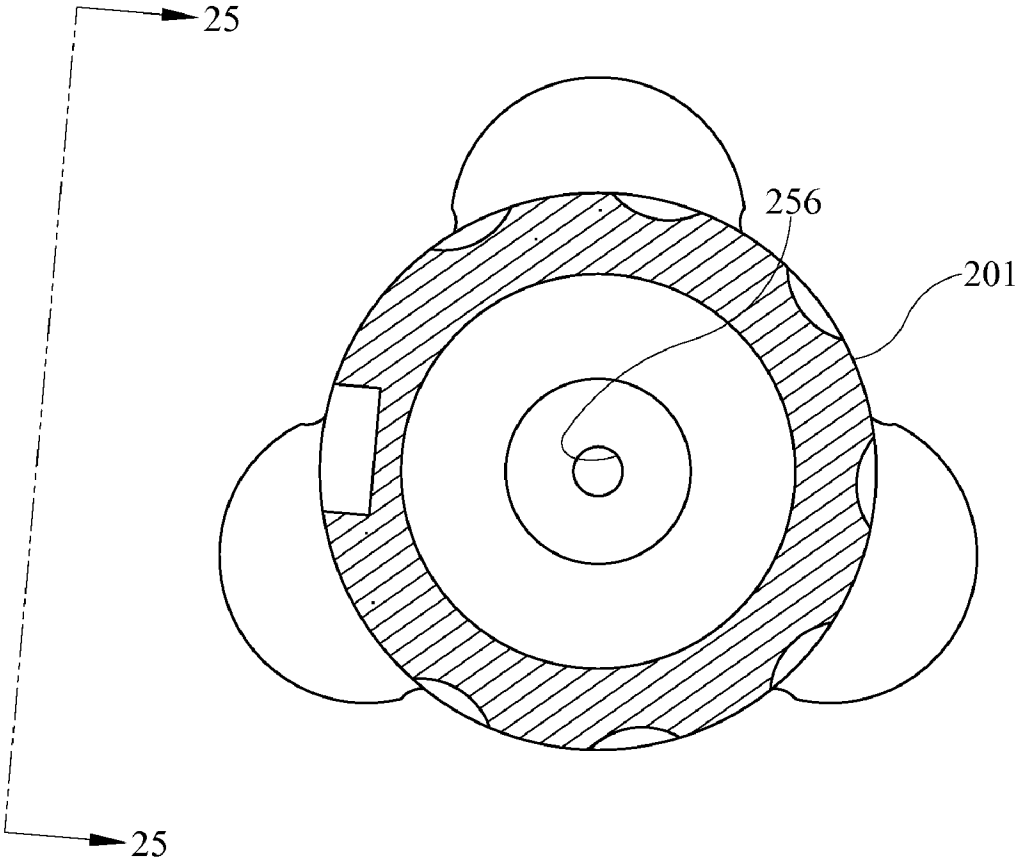
Figure 23:
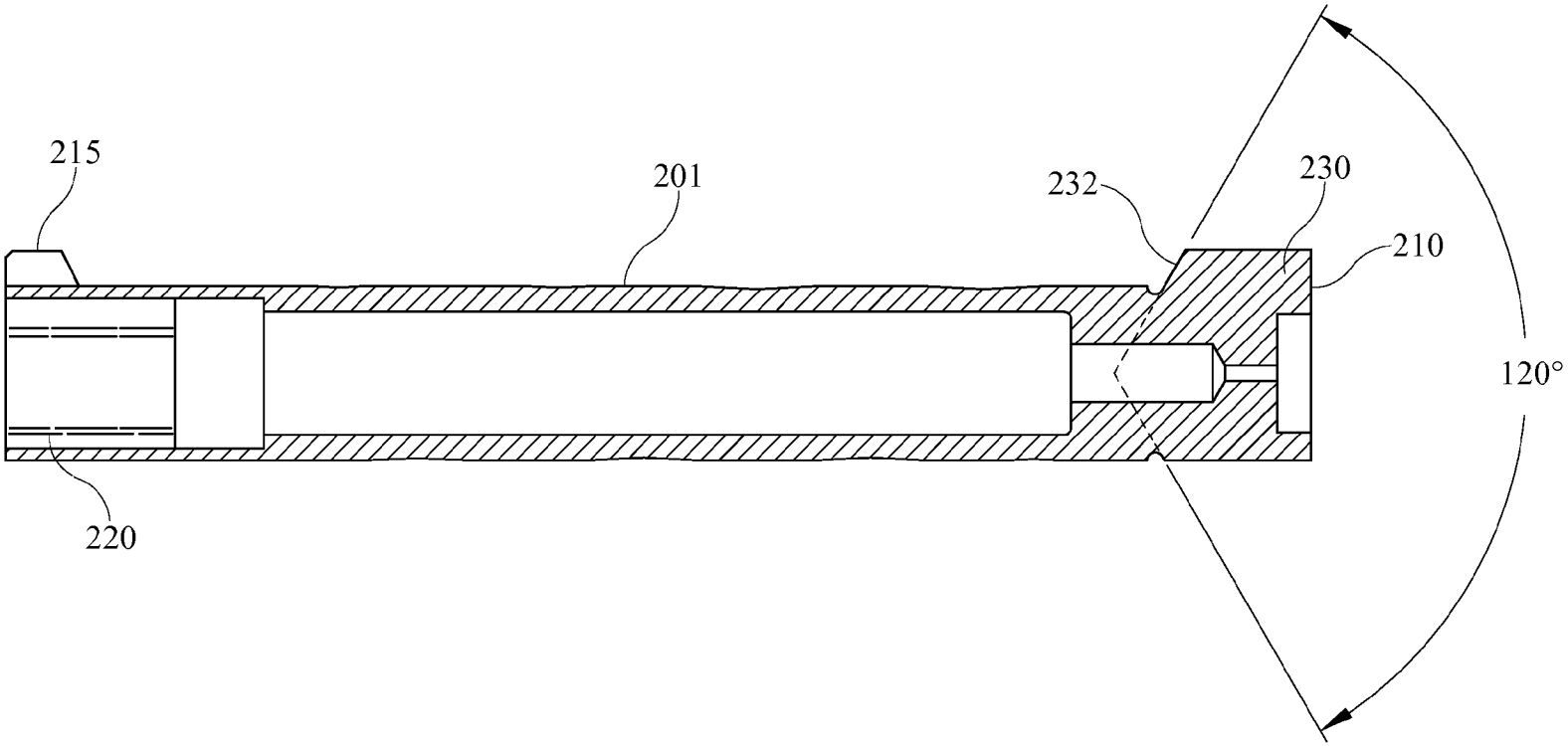
Figure 24:
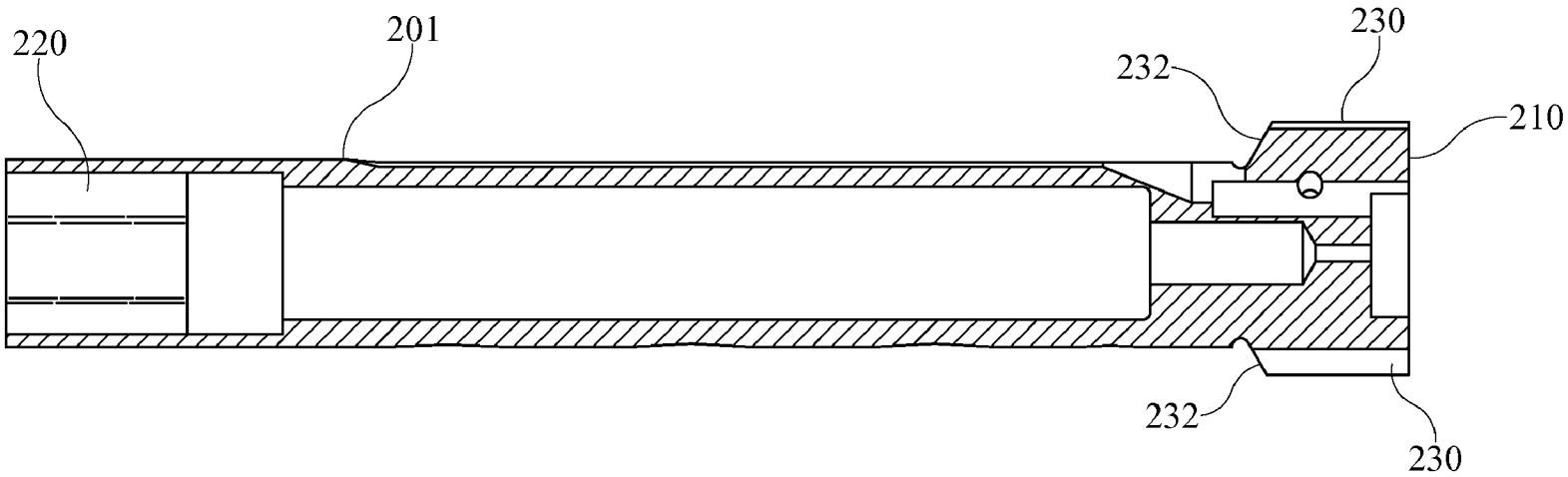
Figure 25:
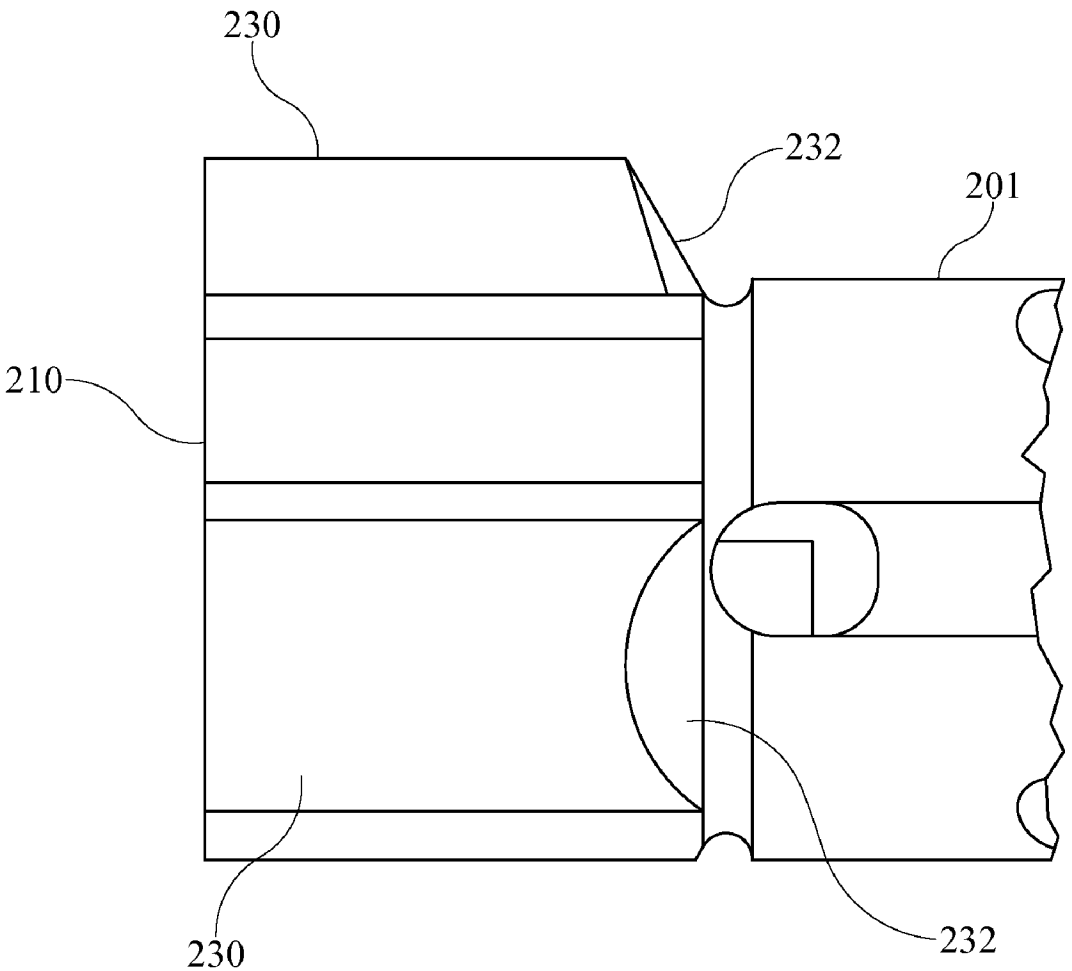
Figure 26:
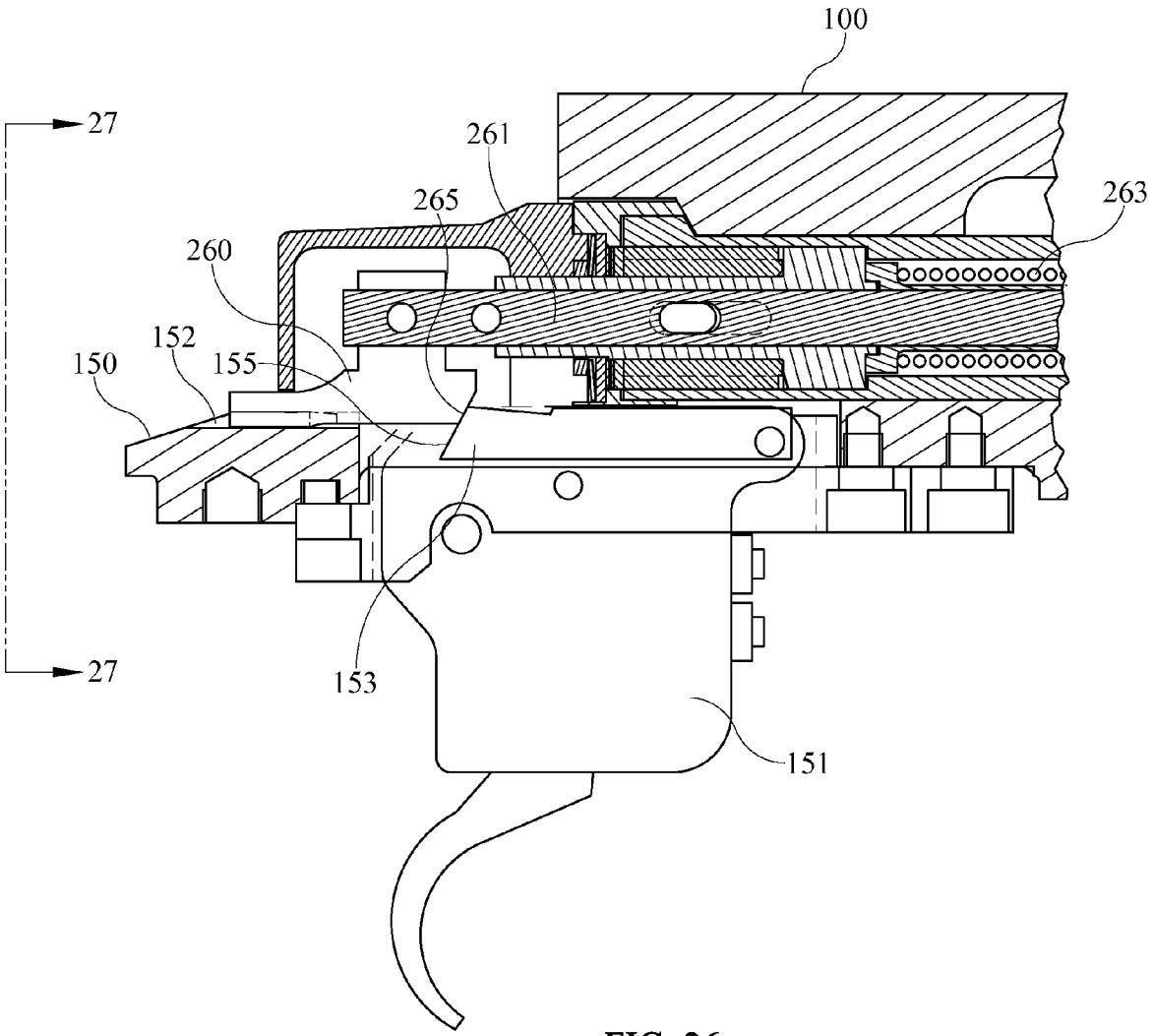

FIG. 16 an exploded view of a bolt assembly in accordance with one embodiment of the present invention;

FIG. 17 is a view of a bolt handle taken along the line 17-17 of FIG. 16 in accordance with one embodiment of the invention;

FIG. 18 is a side view of a bolt in accordance with one embodiment of the present invention;

FIG. 19 is an end view of a bolt taken along the line 19-19 of FIG. 18 in accordance with one embodiment of the present invention;

FIG. 20 is an end view of a bolt taken along the line 20-20 of FIG. 18 in accordance with one embodiment of the present invention;

FIG. 21 is an cross-sectional view of a bolt taken along the line 21-21 of FIG. 18 in accordance with one embodiment of the present invention;

FIG. 22 is an cross-sectional view of a bolt taken along the line 22-22 of FIG. 18 in accordance with one embodiment of the present invention;

FIG. 23 is a cross-sectional view of a bolt taken along the line 23-23 of FIG. 19 in accordance with one embodiment of the present invention;

FIG. 24 is a cross-sectional view of a bolt taken along the line 24-24 of FIG. 19 in accordance with one embodiment of the present invention;

FIG. 25 is a partial side view of a bolt taken along the line 25-25 of FIG. 22 in accordance with one embodiment of the present invention;

FIG. 26 is a partial cross-sectional view of a bolt action assembly in accordance with one embodiment of the present invention.

Figure 27:
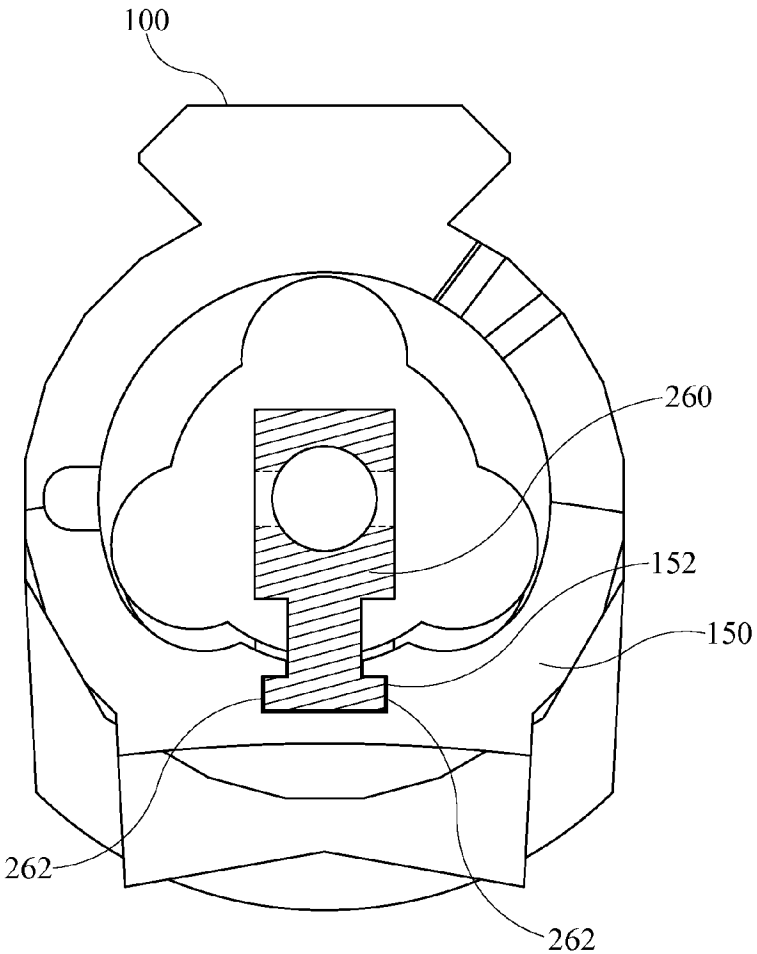

FIG. 27 is an end view of a bolt action assembly taken along the line 27-27 of FIG. 26 in accordance with one embodiment of the invention.

Figure 28:
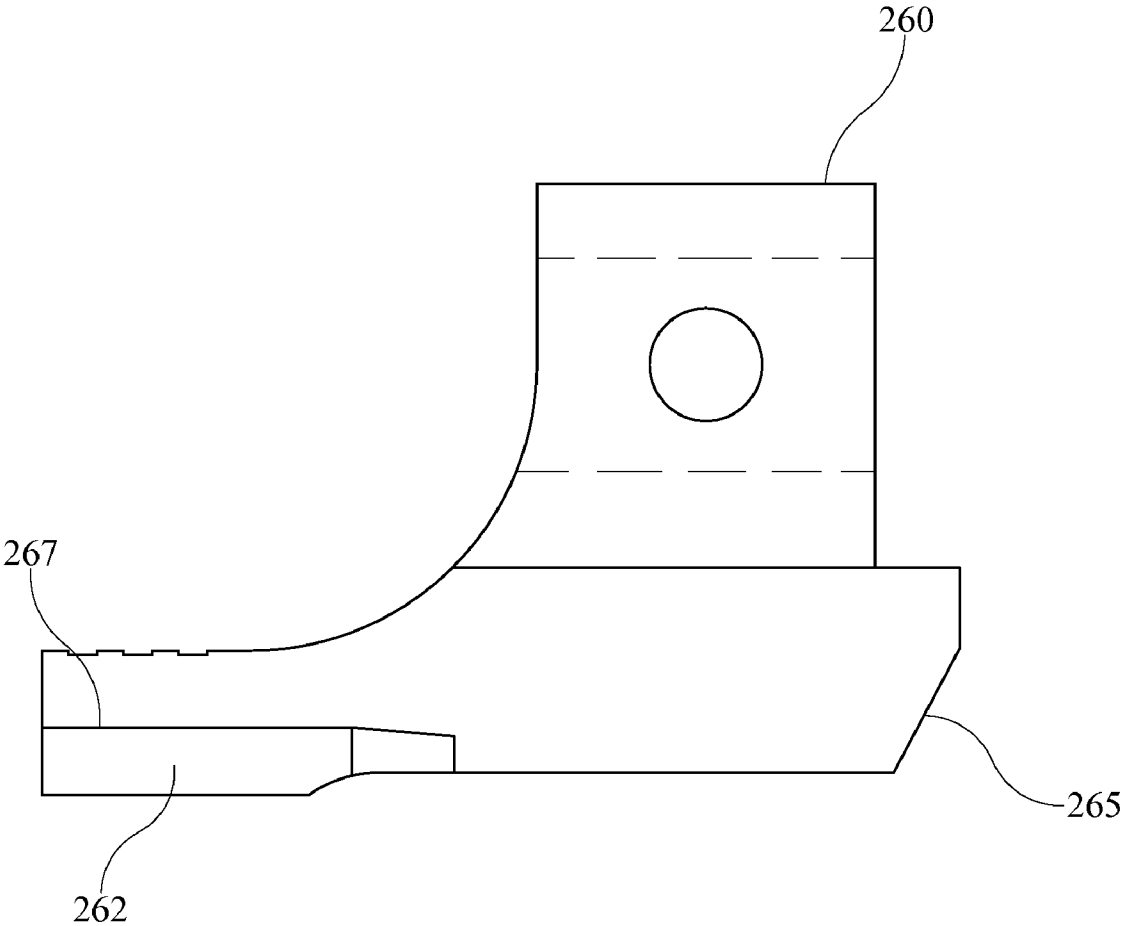
Figure 29:
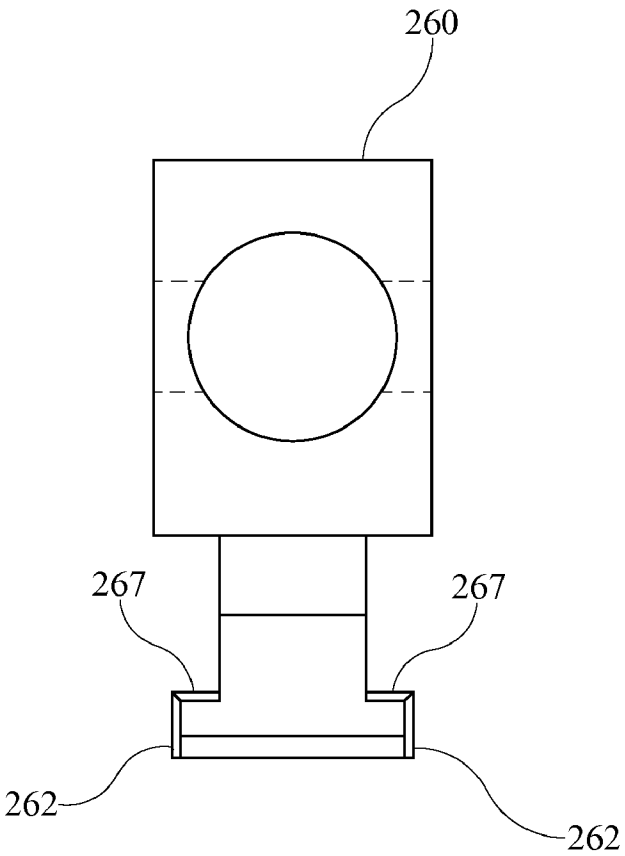
Figure 30:
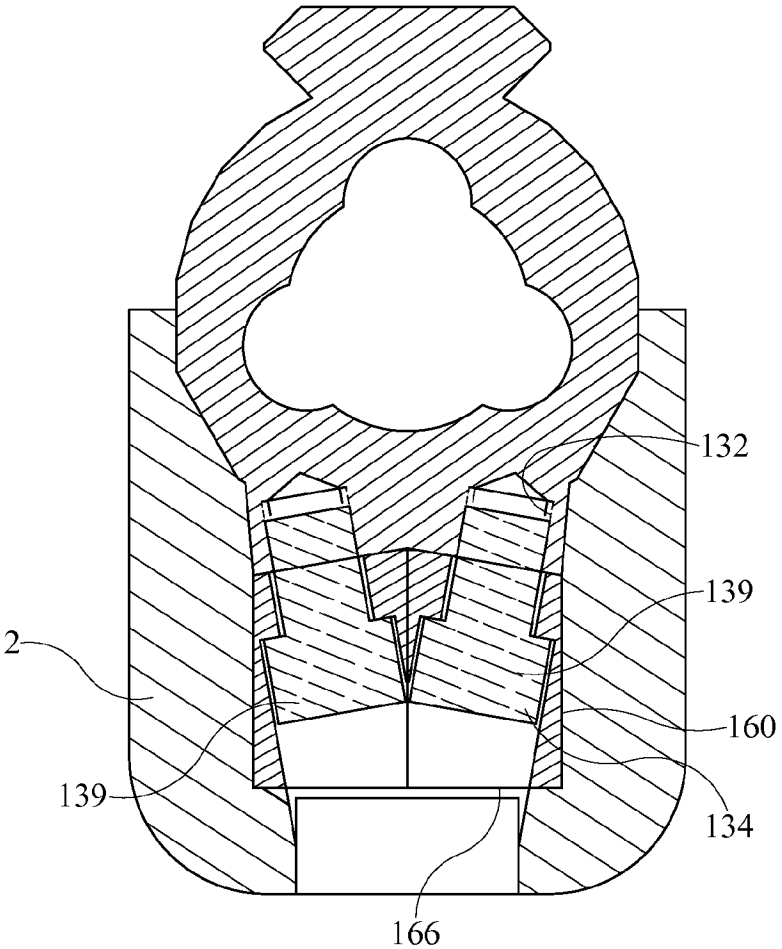
Figure 31:
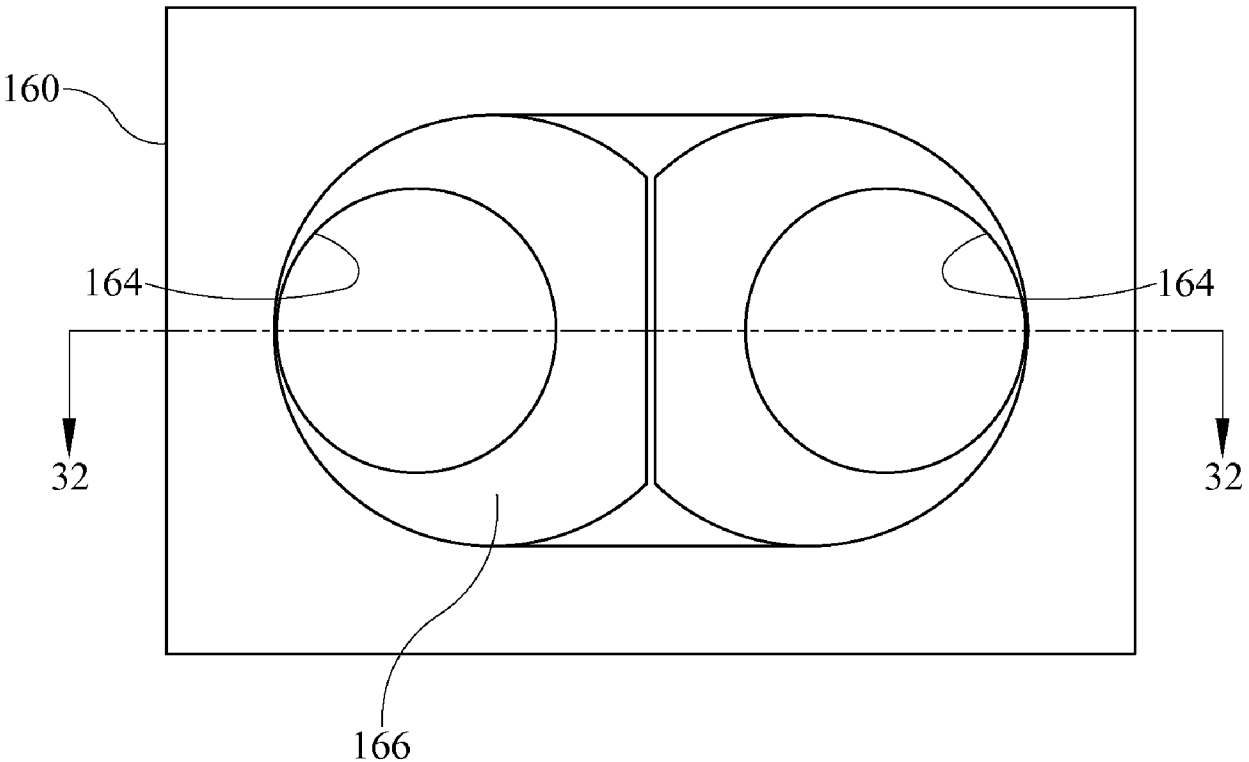
Figure 32:
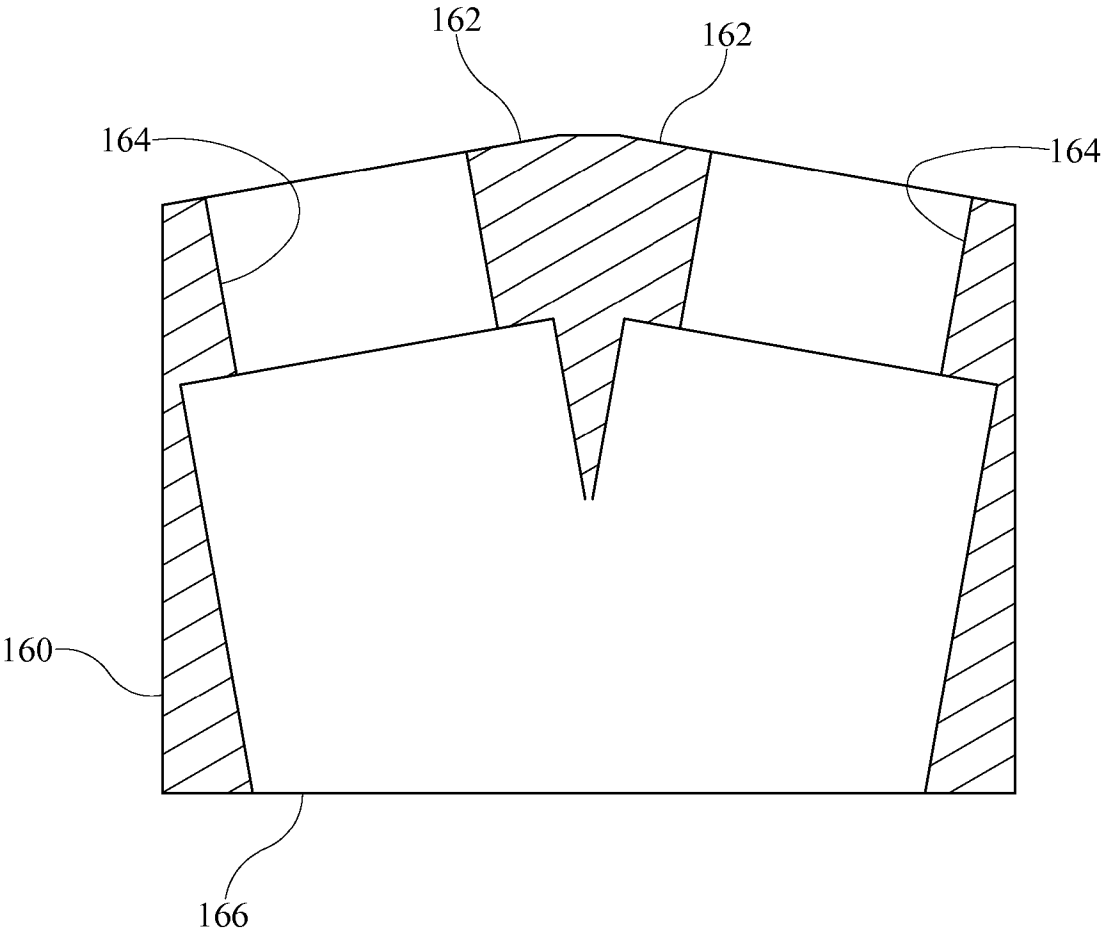
Figure 33:
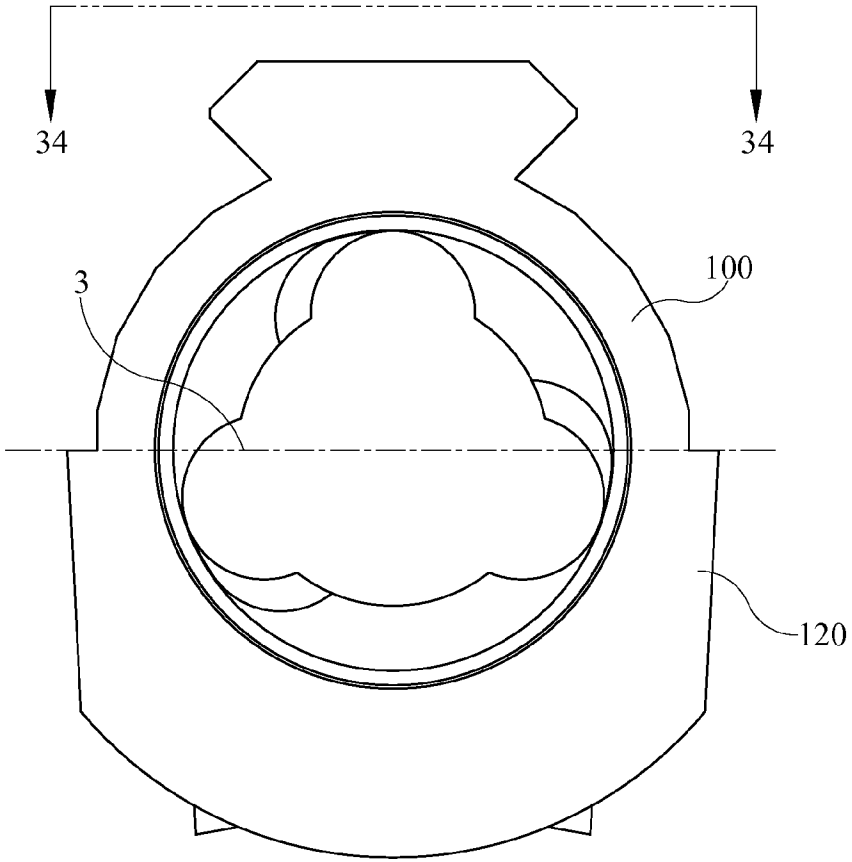
Figure 34:
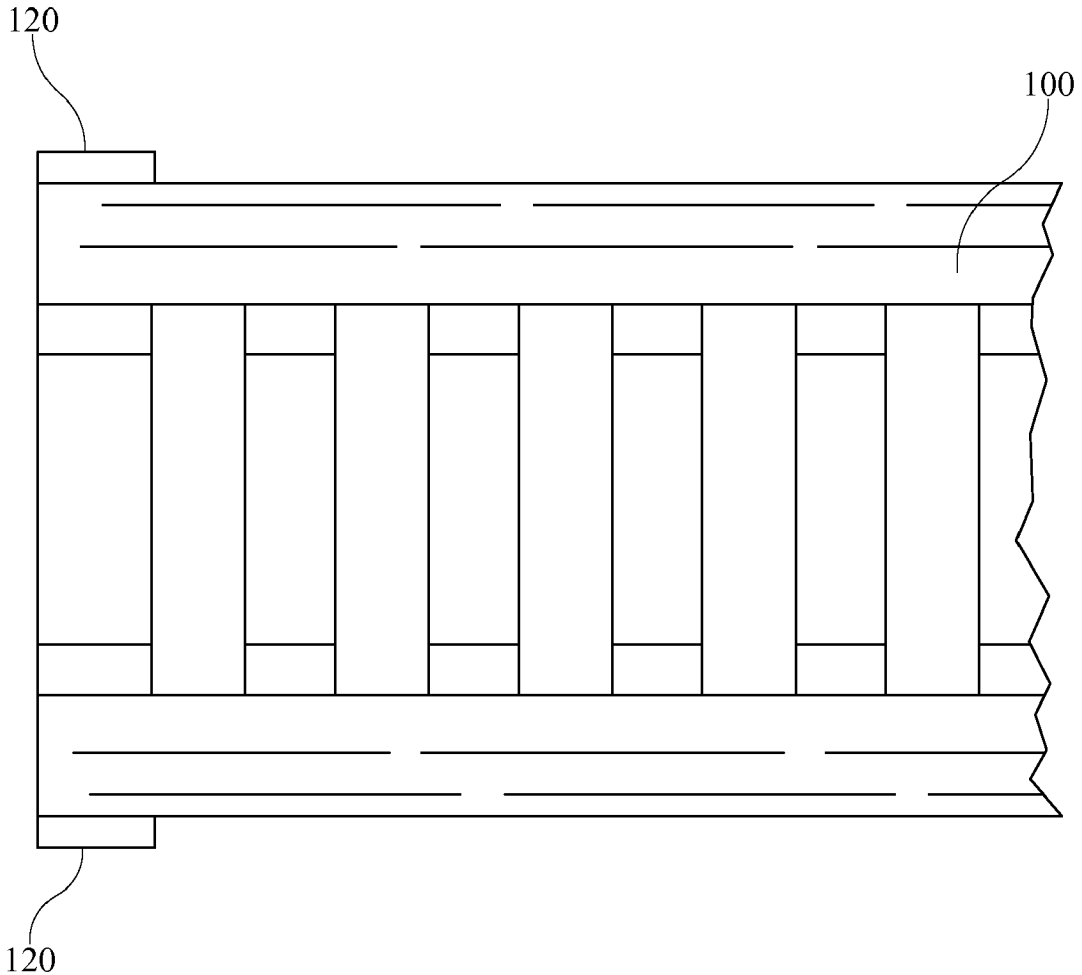
Figure 35:
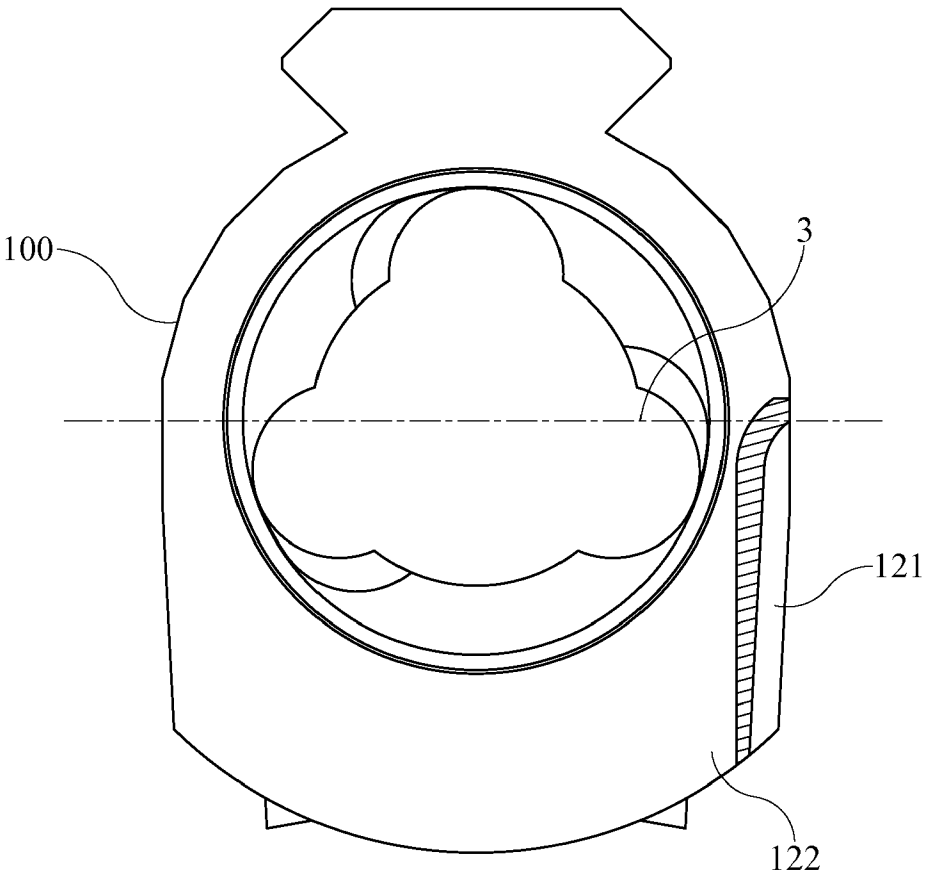

FIG. 28 is a side view of a cocking piece in accordance with one embodiment of the present invention;

FIG. 29 is a front view of a cocking piece in accordance with one embodiment of the present invention;

FIG. 30 is a cross-sectional view of a rifle stock, bolt action and bedding block in accordance with one embodiment of the present invention;

FIG. 31 is a bottom view of a bedding block in accordance with one embodiment of the present invention;

FIG. 32 is a cross-sectional view of a bedding block taken along the line 32-32 of FIG. 31 in accordance with one embodiment of the present invention;

FIG. 33 is an end view of a bolt action receiver in accordance with an alternative embodiment of the present invention;

FIG. 34 is a partial view of a bolt action receiver taken along the line 34-34 of FIG. 33 in accordance with one embodiment of the present invention;

FIG. 35 is an end view of a bolt action receiver in accordance with an alternative embodiment of the present invention.

DETAILED DESCRIPTION OF THE PREFERRED EMBODIMENT(S)

Figure 1:
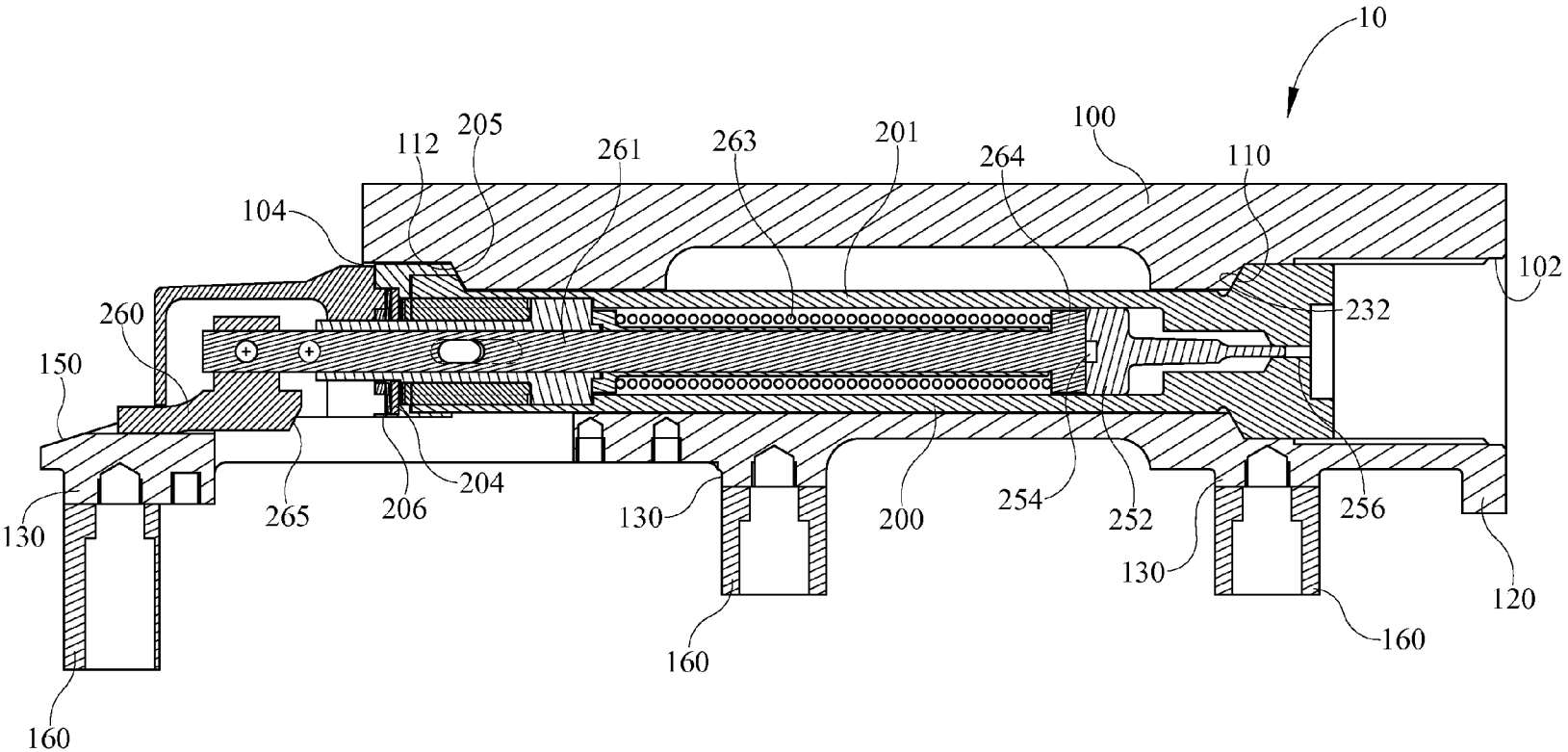
FIG. 1 is a cross-sectional view of a bolt action assembly in accordance with one embodiment of the present invention.
Figure 2:
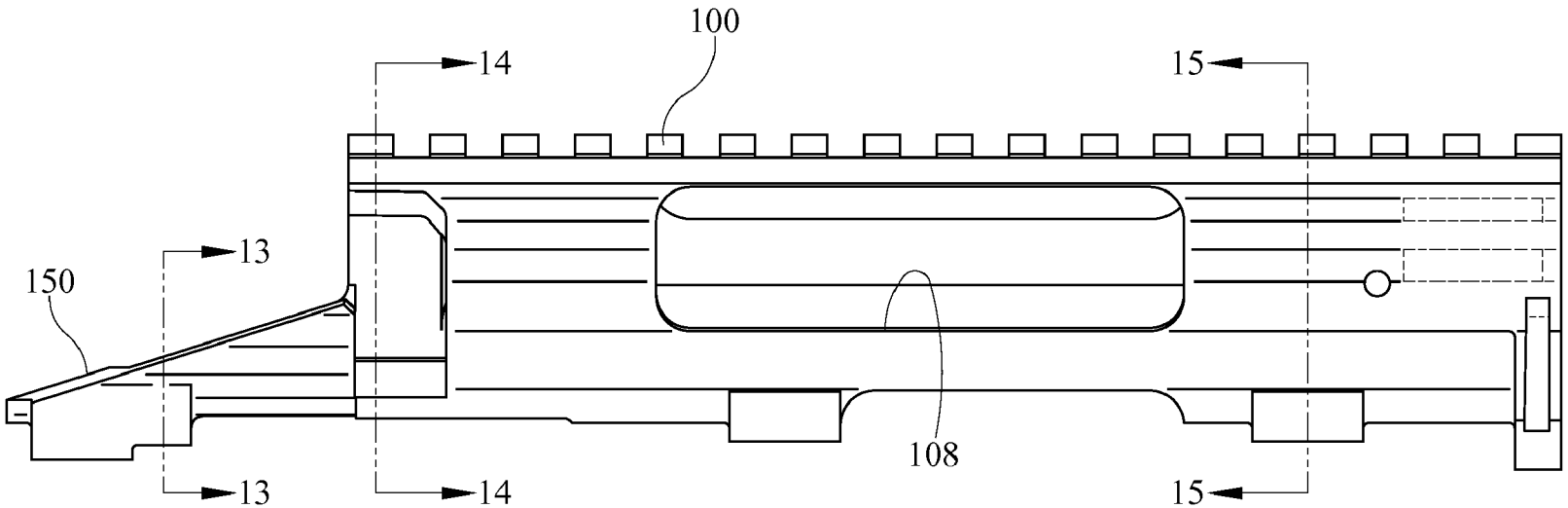
FIG. 2 is a side view of a receiver body in accordance with one embodiment of the present invention.
Figure 3:
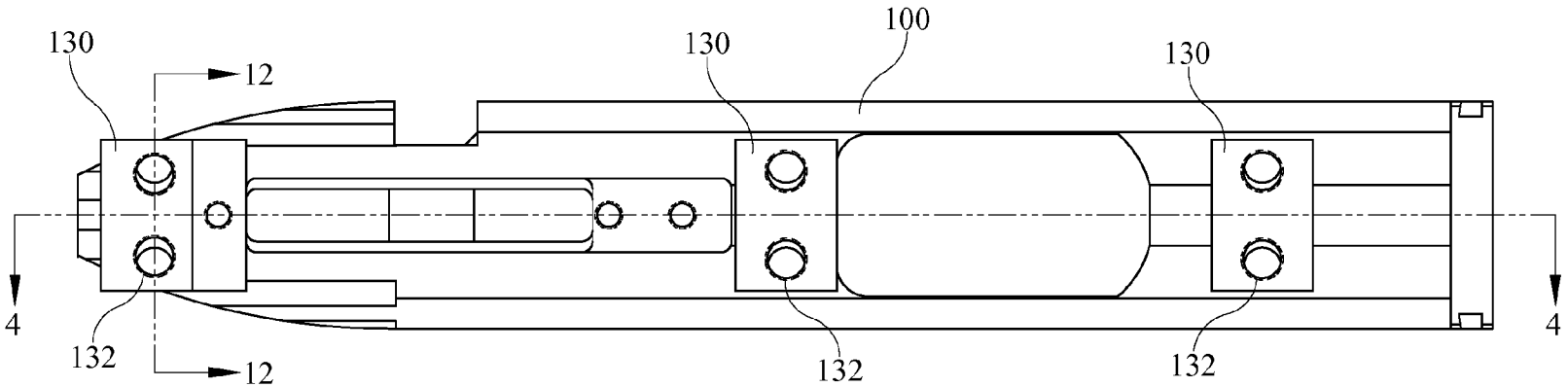
FIG. 3 is a bottom view of a receiver body in accordance with one embodiment of the present invention.
Figure 4:
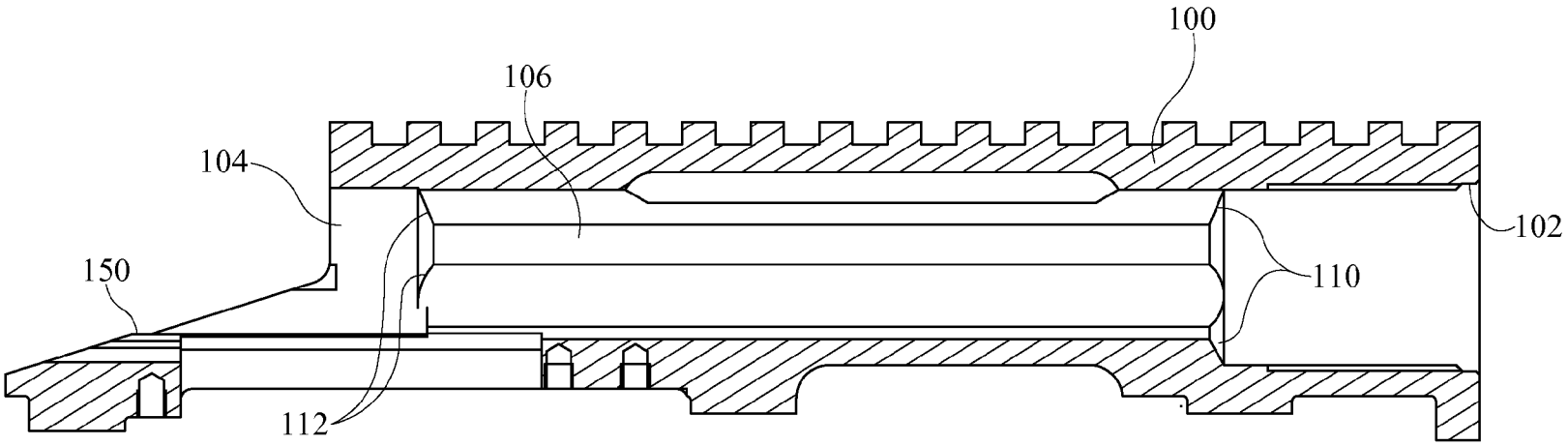
FIG. 4 is a cross-section view of a receiver body taken along the line 4-4 of FIG. 3.
Figure 5:
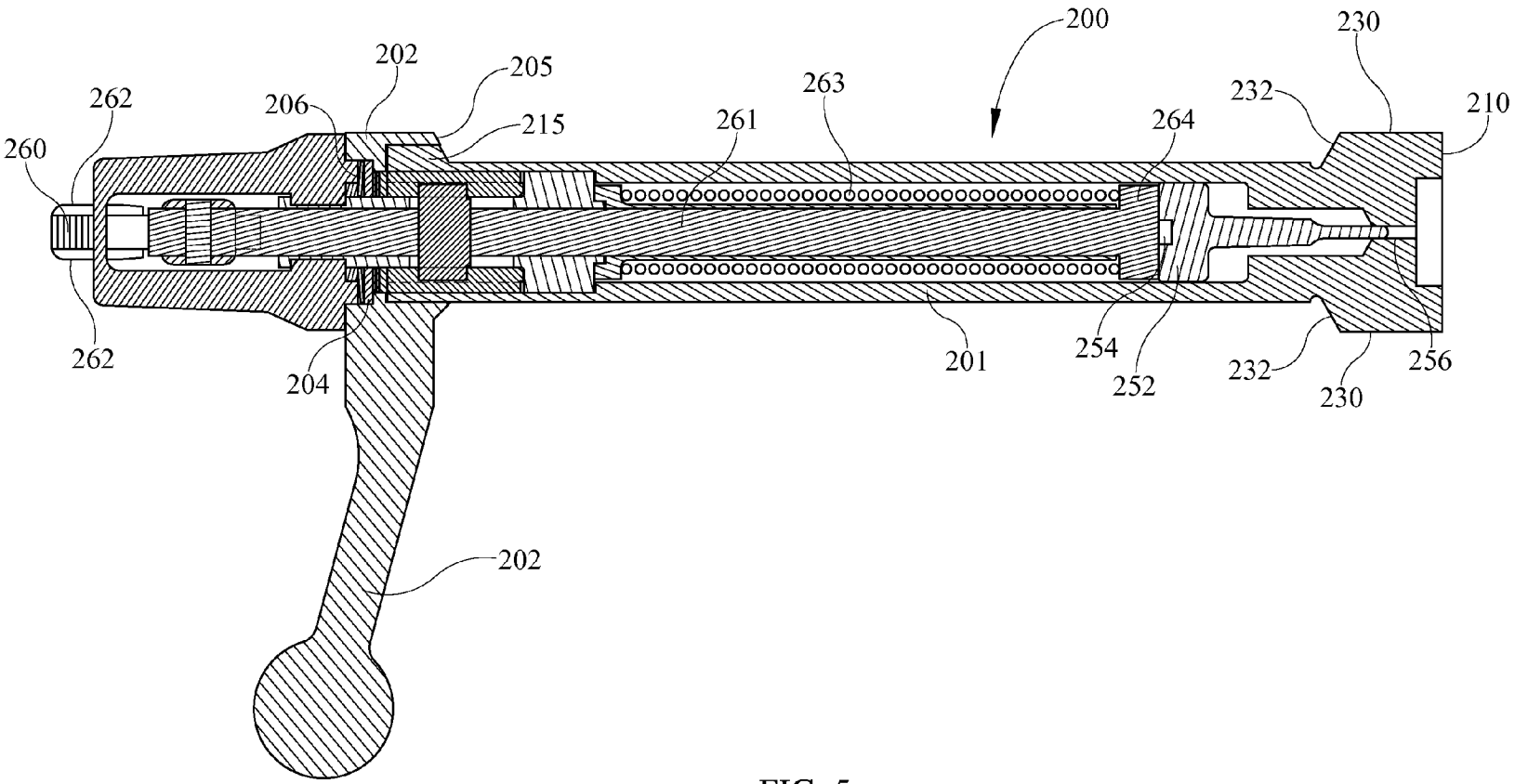
FIG. 5 is a top cross-sectional view of a bolt assembly in accordance with one embodiment of the present invention.
Figure 6:
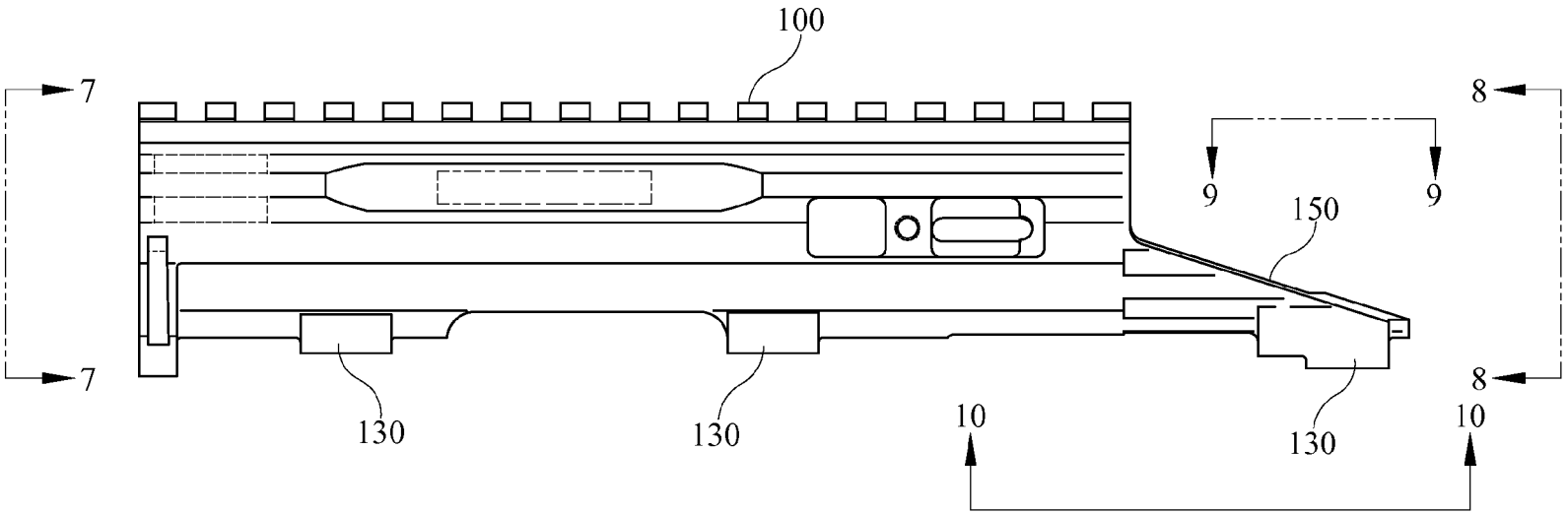
FIG. 6 is a offside view of a receiver body in accordance with one embodiment of the present invention.
Figure 7:
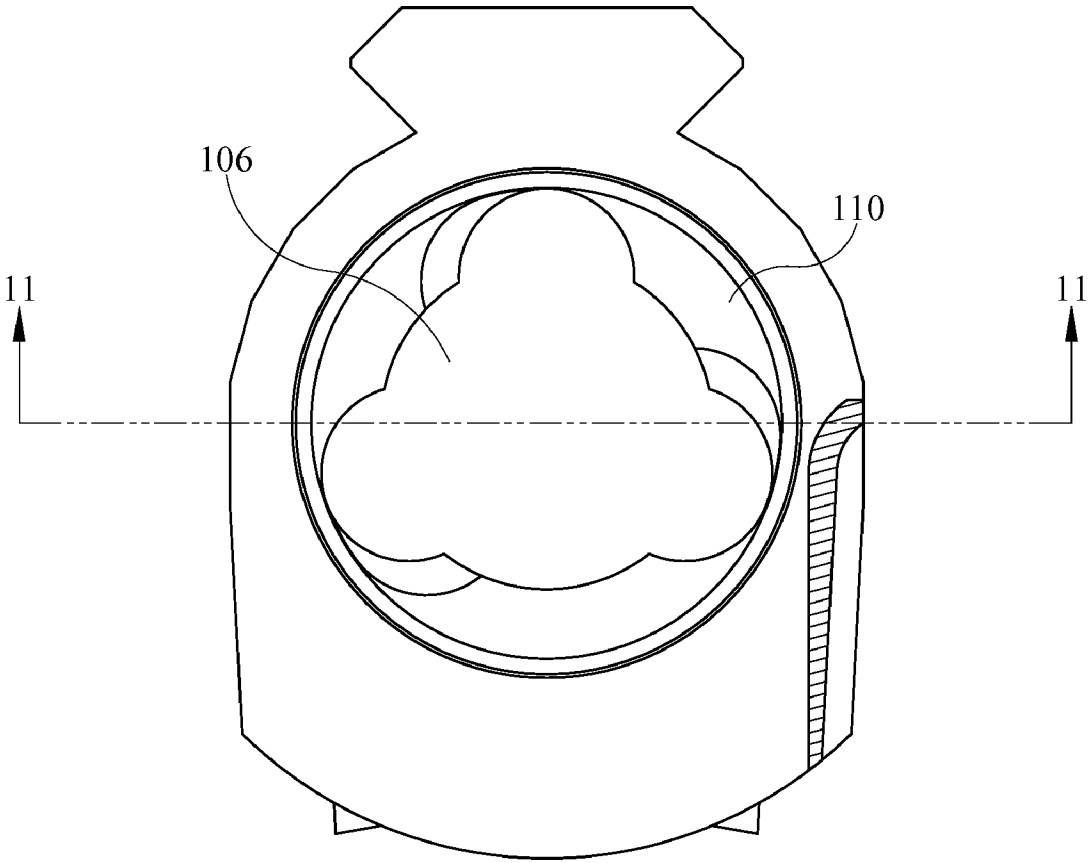
FIG. 7 is an end view of a receiver body taken along the line 7-7 of FIG. 6 in accordance with one embodiment of the present invention.
Figure 8:
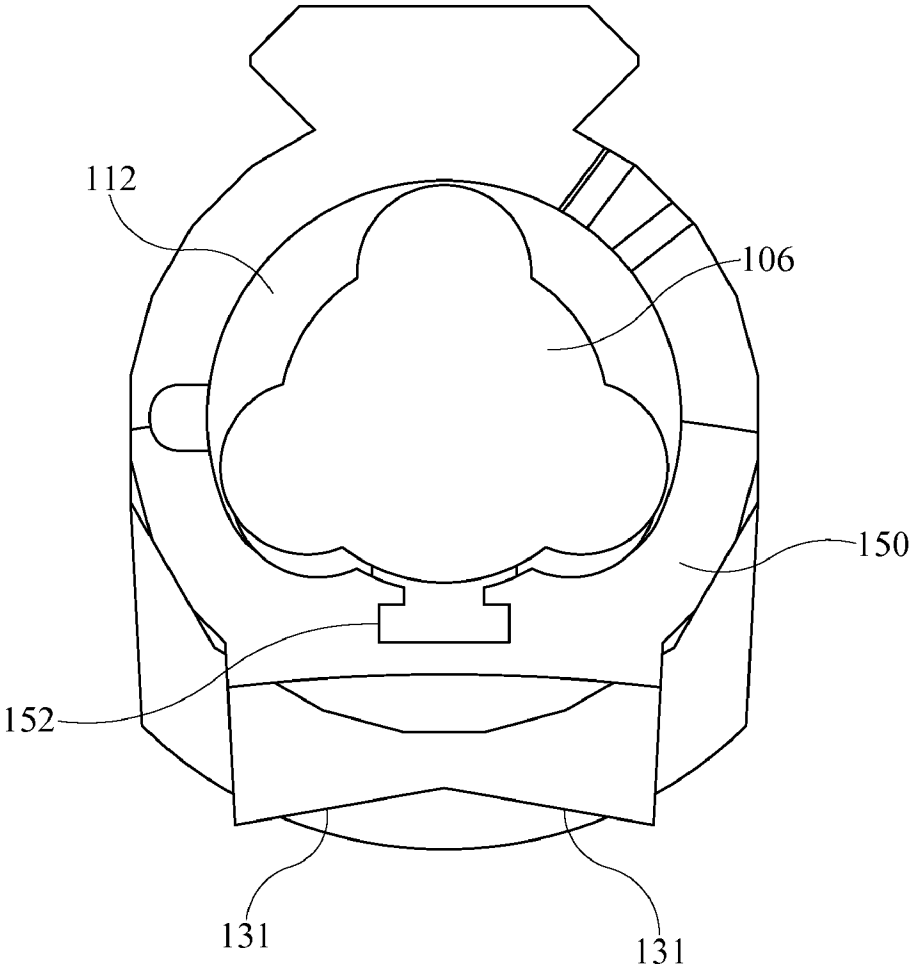
FIG. 8 is an end view of a receiver body taken along the line 8-8 of FIG. 6 in accordance with one embodiment of the present invention.
Figure 9:
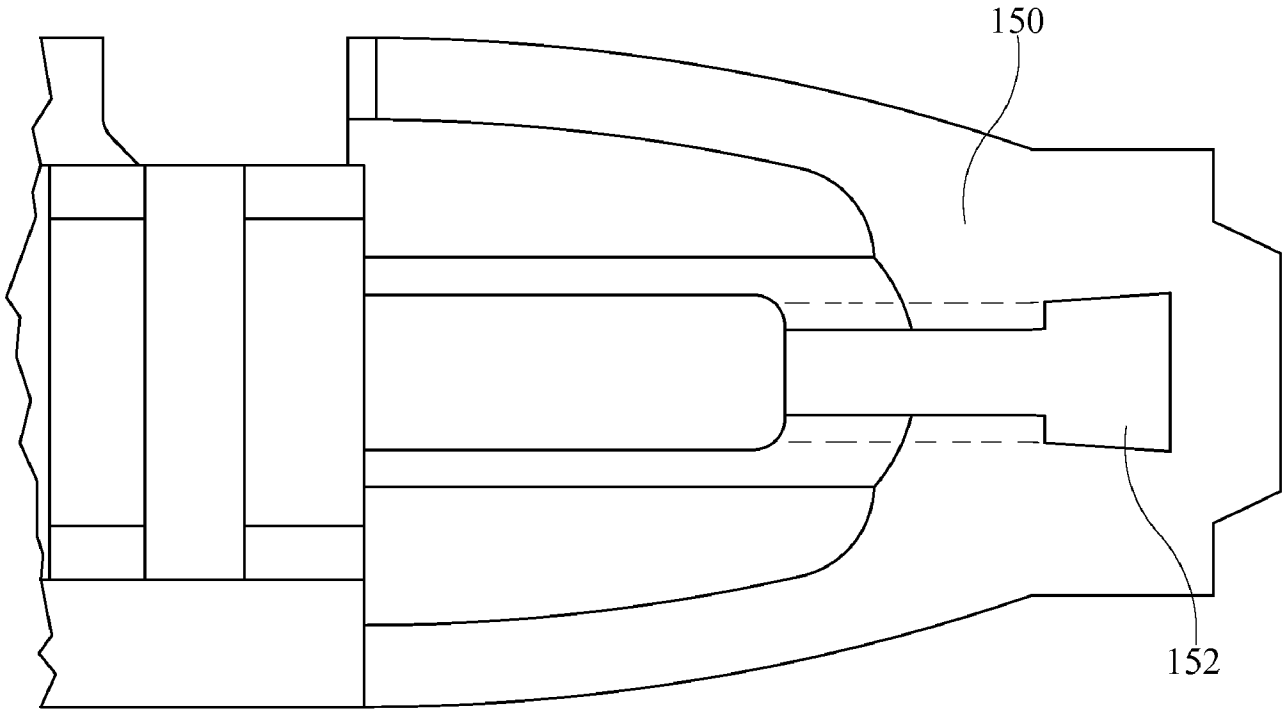
FIG. 9 is a partial top view of a receiver body taken along the line 9-9 of FIG. 6 in accordance with one embodiment of the present invention.
Figure 10:
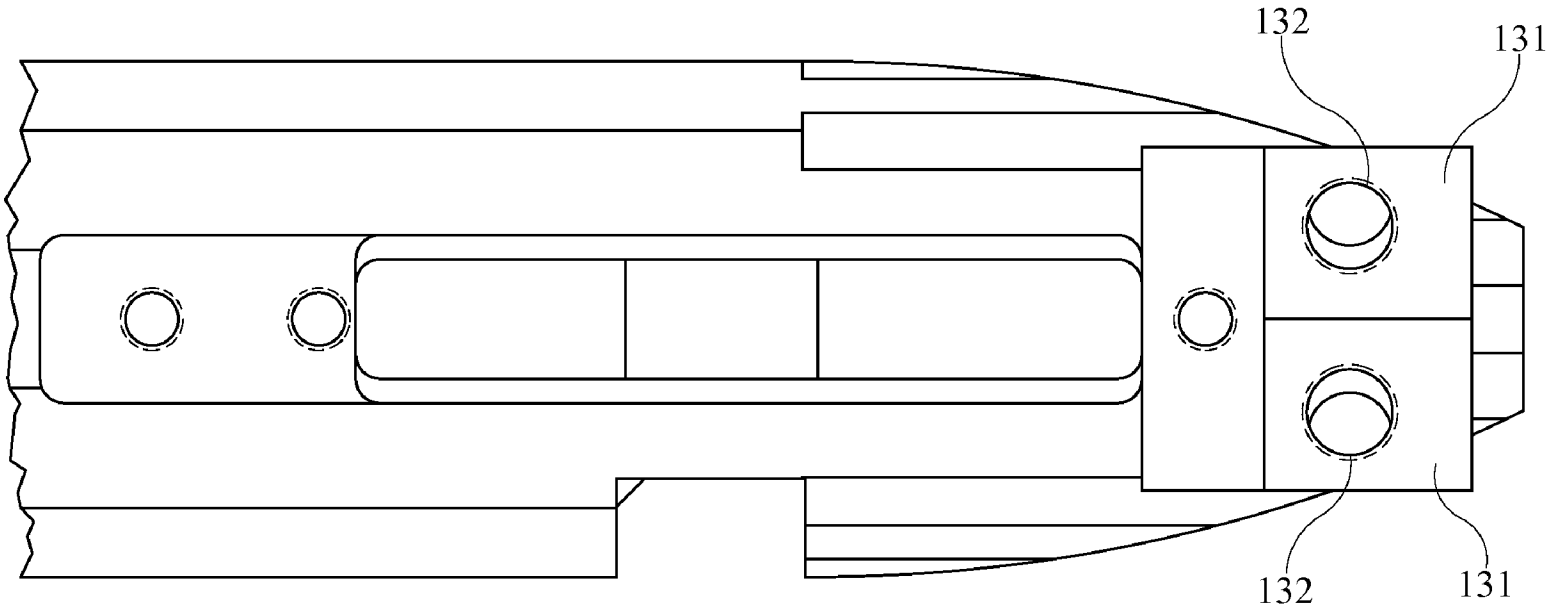
FIG. 10 is a partial bottom view of a receiver body taken along the line 10-10 of FIG. 6 in accordance with one embodiment of the present invention.
Figure 11:
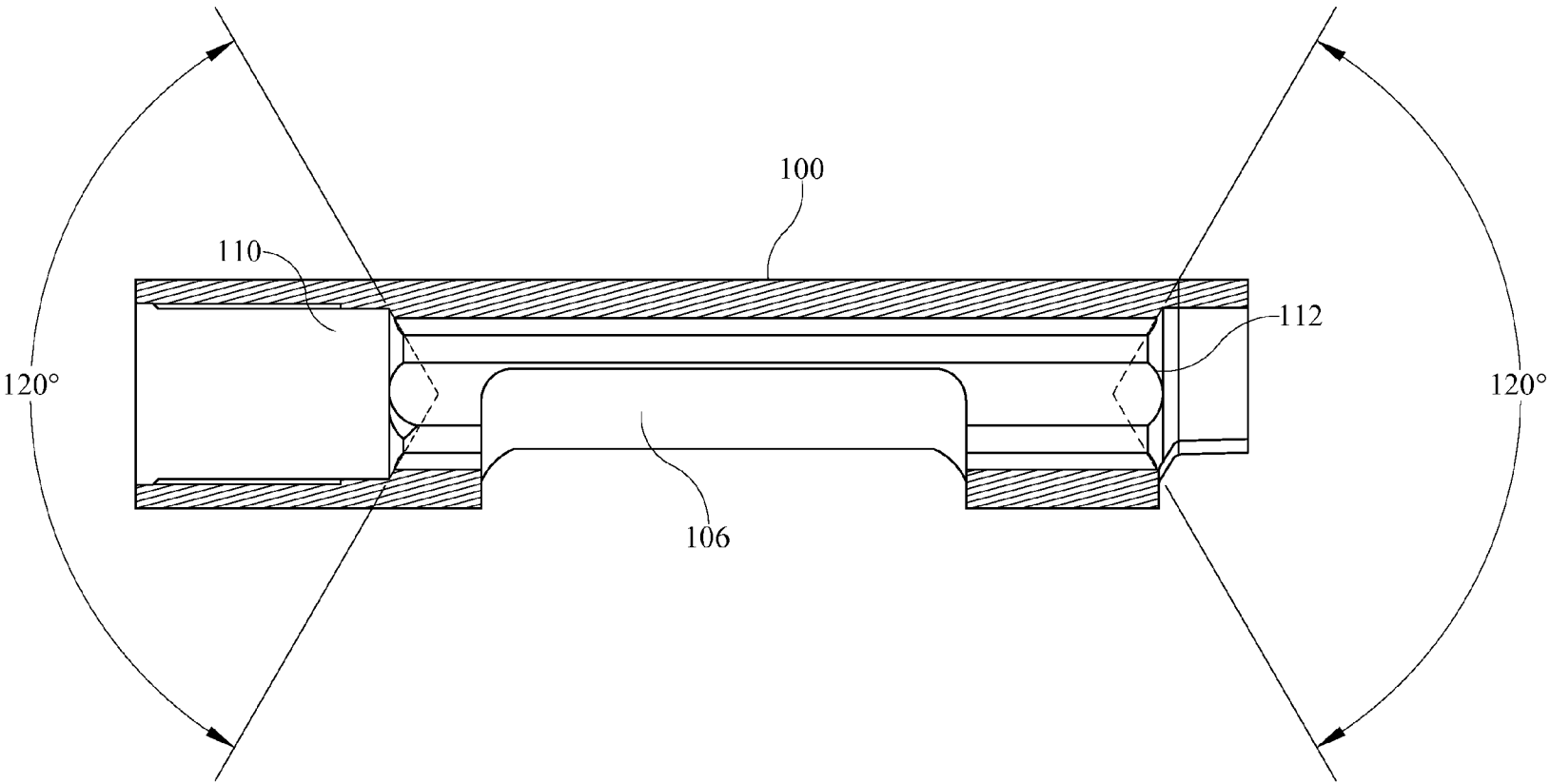
FIG. 11 is a cross-sectional view of a receiver body taken along the line 11-11 of FIG. 7 in accordance with one embodiment of the present invention.
Figure 13:
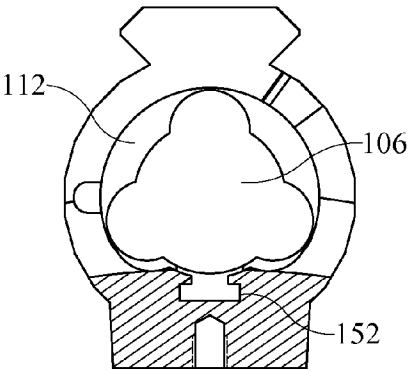
FIG. 13 is a cross-sectional view of a receiver body taken along the line 13-13 of FIG. 2 in accordance with one embodiment of the present invention.
Figure 15:
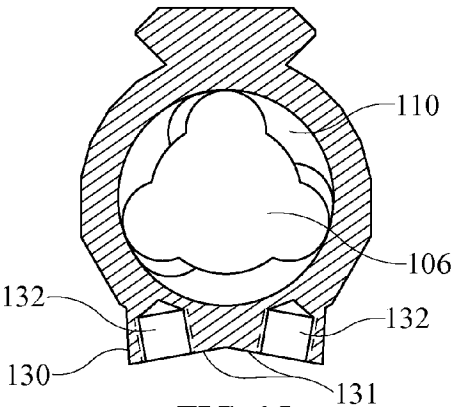
FIG. 15 is a cross-sectional view of a receiver body taken along the line 15-15 of FIG. 2 in accordance with one embodiment of the present invention.
Figure 12:
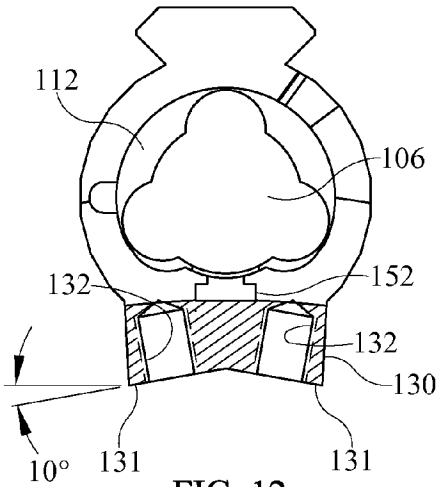
FIG. 12 is a cross-sectional view of a receiver body taken along the line 12-12 of FIG. 3 in accordance with one embodiment of the present invention.
Figure 14:
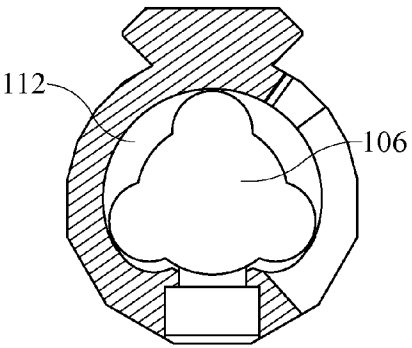
FIG. 14 is a cross-sectional view of a receiver body taken along the line 14-14 of FIG. 2 in accordance with one embodiment of the present invention.

Referring now to FIGS. 1-5, and in accordance with a preferred constructed embodiment of the present invention a novel bolt action assembly 10 is shown, intended to be mounted into a stock of a firearm. Bolt action 10 comprises a receiver body 100 and a bolt assembly 200 that is adapted to be received within receiver body 100. Receiver body 100 has a forward aperture 102 that is concentric with and in communication with a barrel of a firearm, and a rear aperture 104 through which bolt assembly 200 may be inserted. Apertures 102 and 104 are connected by a central bore 106 within receiver body 100. As best seen in FIG. 2, receiver body 100 also may include a loading port 108 into which a cartridge (not shown) may be inserted for loading into the breech of the firearm barrel (also not shown).

Receiver body 100 further comprises forward conical seat surface 110 and rear conical seat surfaces 112 that are located at opposed ends of central bore 106, extend generally radially inwardly, and are adapted to be engaged by complementary surfaces of bolt assembly 200, as will be discussed herein below. Receiver body 100 conical seat surfaces 110 and 112 permit a forward and rear portion of bolt assembly 200 to be secured within receiver body 100 concentric with the firearm barrel, thereby permitting accurate and repeatable firing of the firearm.

Referring now to drawing FIGS. 1, 5, 16 and 17 bolt assembly 200 comprises a generally cylindrical bolt body 201 and a floating bolt handle 202. Bolt handle 202 includes a plurality of grooves 203 in a central aperture 207 thereof adapted to engage a rear portion 220 of said bolt body 201 by mating with complementary rear splines 215 of said bolt body 201. Rear splines 215 may include an angled surface on a forward portion thereof, as shown in FIG. 16. Bolt handle 202 further comprises a front conical surface 205 that contacts rear conical seat surface 112 of receiver body 100, as best seen in FIG. 1. Close manufacturing tolerance of mating surfaces at rear end 220 of said bolt body 201 and bolt handle 202 prohibits axial movement of said bolt handle 202 thereby maintaining concentricity of conical surface 205 to bolt body 201.

Bolt assembly 200 further comprises a forward end 210 having a plurality of locking lugs 230 extending radially outwardly therefrom, each locking lug 230 having surfaces 232 thereon shaped to contact front conical seat surfaces 110 of receiver body 100. Bolt assembly 200 may be inserted through rear aperture 104 of receiver body 100, and once fully inserted therein, said bolt assembly 200 is rotated by operation of floating bolt handle 202 in conjunction with rear splines 215. When rotated, surfaces 232 of locking lugs 230 engage complementary front conical seat surface 110 of receiver body 100 and front conical surface 205 of floating bolt handle 202 engages complementary rear conical surface 112 of receiver body 100, thereby securing forward end 210 and rear end 220 of bolt body 201 concentrically with a firearm barrel.

Referring primarily to FIGS. 1, 5, 16 and 17, bolt assembly 200 further comprises a bolt handle clutch 204 and a conical disk spring 206 located adjacent thereto. Conical disk spring 206 and bolt handle clutch 204 operate to pressurize bolt handle 202 as bolt handle 202 is rotated downwardly to a closed position, thereby centering bolt assembly 200 in the receiver body 100. In this fashion, both forward end 210 and rear end 220 of bolt body 201 are locked into position concentrically with a firearm barrel, and concentrically with receiver body 100 at two ends thereof. Thus when assembled, bolt body 201 of the present invention can not move relative to receiver body 100, even when the firearm is discharged, thereby minimizing vibrations and enhancing accuracy. Furthermore, as best shown in FIG. 1, bolt body 201 is held suspended by both forward end 210 and rear end 220 of bolt body 201 such that bolt body 201 inside central bore 106 of receiver body 100 has no contact with central bore 106, except at the aforementioned mating surfaces 112, 205, 110 and 232.

Additionally, bolt handle clutch 204 operates to compress conical disk spring 206 during lifting of bolt handle 202 and rotation of bolt body 201 inside receiver body 100, thereby relieving pressure between front conical surface 205 of said bolt handle 202 and conical seat surface 112 of receiver body 100. This feature of the present invention minimizes the pressure felt by an operator during opening and closing of bolt assembly 200 in said receiver body 100, which makes operation of the present invention quite smooth despite extremely tight manufacturing tolerances on mating surfaces.

Bolt assembly 200, as best seen in FIGS. 1, 5 and 26-29 further comprises a cocking piece 260 attached to a firing pin shank 261 at a rear portion thereof, and a firing pin spring 263 compressed by an annular forward portion 264 of firing pin shank 261. Cocking piece 260 further includes an angled surface 265 as will be discussed further below. Additionally, receiver body 100 houses a trigger group 151 at bottom rear portion thereof, said trigger group 151 comprising a sear 153 with angled surface 155 to engage complementary angled surface 265 of cocking piece 260.

Referring now to drawing FIGS. 2-11 and 26-29, receiver body 100 comprises a tang 150 at rear portion thereof, said tang 150 having a t-slot 152 therein for accepting complementary cocking piece 260 at rear portion of bolt assembly 200. Cocking piece 260 includes a pair of opposed extended flanges 262 having upper surfaces 267, said flanges 262 engaging t-slot 152 of receiver body 100. The ability of angled surface 265 of cocking piece 260 to angularly "ride" or lift upwardly along angled surface 155 of sear 153 under pressure by firing pin spring 263 is prohibited by close engagement of top surfaces 267 of extended flanges 262 with t-slot 152 of receiver body 100. Thus, rear bolt lift is prevented during closing of bolt assembly 200 under pressure from firing pin spring 263. Flanges 262 of cocking piece 260 along with t-slot 152 are machined to a tight tolerance to prohibit this rear bolt lift.

Referring now to drawing FIGS. 1, 5 and 19-22, bolt assembly 200 further comprises a firing pin 252 having a magnetic portion 254 disposed at a rearward portion thereof, such that the firing pin 252 maintains contact with the firing pin shank 261, but is free to move axially with respect to said firing pin shank 261 forward portion 264, and the remaining components comprising bolt assembly 200. This enables the firing pin 252 to extend through a firing pin aperture 256 disposed through forward end 210 of bolt assembly 200 to contact a cartridge primer (not shown) without being subjected to off-axis forces. In other words, firing pin 252 "floats" with respect to the firing pin mechanism, which enables accurate and on-axis engagement of firing pin 252 with a cartridge through firing pin aperture 256. Furthermore, magnetic portion 254 of firing pin 252 operates to maintain constant contact with firing pin shank 261, eliminating metal to metal impact of components during forward movement of said firing pin shank 261, and further facilitates the removal and reinsertion of firing pin 252. This feature of the invention allows simple replacement of firing pin 252 if the need should arise. Maintaining constant contact between firing pin 252 and firing pin shank 261 also prevents firing pin 252 from inadvertently contacting a cartridge primer until the actual event of decompressing of firing pin spring 263 in discharging the firearm.

Referring now to drawing FIGS. 1, 12-15 and 30-32, receiver body 100 further comprises a plurality of bottom mounting pads 130 comprised of two angled surfaces 131 disposed at equilaterally to a vertical line bisecting said receiver body 100. Into surfaces 131 are disposed a plurality of action screw threaded holes 132 having conventional helical threads therein and having their axes perpendicular to angled surfaces 131.

As best seen in FIGS. 30-32 the invention further comprises a plurality of bedding blocks 160 for securing receiver body 100 to a firearm stock2, shown in cross-section in FIG. 30. Bedding blocks 160 comprise a pair of angled mounting surfaces 162 shaped to mate with complementary receiver 100 angled surfaces 131 as well as a pair of action screw holes 164, disposed at an angle that matches the axes of action screw threaded holes 132. Bedding blocks 160 further comprise a single port 166 through which action screw holes 164 may be accessed.

As best seen in FIG. 30, angled surfaces 131 complement mating angled surfaces 162 of bedding blocks 160. Bedding blocks 160 are permanently attached to firearm stock 2 and then action screws 139 are inserted through port 166 and action screw holes 164 and fastened into action screw threaded holes 132. This feature of the present invention permits receiver body 100 to be secured to firearm stock 2 with a plurality of action screws 139, each set at an angle to more equilaterally fasten receiver body 100 to firearm stock 2. Furthermore, each bedding block 160 accepts two action screws 139 at an angle to permit removal and insertion through a common single port 166 at bottom of firearm stock 2. In contradistinction to prior art systems, the present invention enables additional action screws 139 to be employed to create a stronger bond between receiver body 100 and firearm stock 2 without creating unsightly additional holes at the bottom of firearm stock 2. Additionally, the mating of angled surfaces 131 of receiver body 100 to angled surfaces 162 of bedding blocks 160 greatly aids the centering of receiver body 100 into firearm stock 2, thereby preventing side movement during installation of receiver body 100 to firearm stock 2 by simply tightening action screws 139.

Referring now to drawing FIGS. 1 and 33-35, receiver body 100 further comprises a radial recoil lug 120 that may extend outwardly from and up to 180 degrees around receiver body 100, for example around a bottom portion thereof. Alternatively, as seen in FIG. 35, receiver body 100 comprises a recoil lug 122 having side grooves 121 along its sides up to and discontinued at centerline 3 of receiver body 100. Both radial recoil lugs 120 and 122 transfer recoil energy created by the firing of the firearm. During firing, recoil energy from powder ignition is transferred to areas of the firearm well below the centerline of the barrel bore. With the mass of the barrel and action above the centerline of the bore capable of free movement during recoil, this off-center recoil energy creates an upward torque of the barreled action, attempting to force the action from stock 2. Accordingly, recoil lugs 120, 122 and side grooves 121, which are both integral with and machined into receiver body 100 act to transfer energy from the recoil of the firearm in line with the centerline of the bore, thereby reducing the upward torque caused by recoil, minimizing stress on the union of receiver body 100 and firearm stock 2, and minimizing any additional vibrations caused therein, thus resulting in more accurate firing.

While the present invention has been shown and described herein in what are considered to be the preferred embodiments thereof, illustrating the results and advantages over the prior art obtained through the present invention, the invention is not limited to those specific embodiments. Thus, the forms of the invention shown and described herein are to be taken as illustrative only and other embodiments may be selected without departing from the scope of the present invention, as set forth in the claims appended hereto.

I claim:

1. A bolt action for a firearm having a barrel with a bore therein comprising:

a receiver body having a forward and a rear aperture connected by a central bore therethrough, and a loading port in communication with said central bore for accepting a cartridge, and having a plurality of forward and rear conical seat surfaces proximate said forward and rear apertures;

a bolt body having a forward and a rear end, a plurality of locking lugs disposed on the forward end thereof for engaging said forward conical surfaces of said receiver body and having a plurality of splines extending radially outwardly from the rear end thereof;

a floating bolt handle for engaging said rear conical surfaces of said receiver body when said handle is rotated, said bolt handle having a central aperture with a plurality of grooves therein for engaging said plurality of splines of said receiver body; and a conical disk spring and a bolt handle clutch disposed between said conical disk spring and said bolt handle for pressurizing said bolt handle as said handle is rotated to a closed position, thereby centering said bolt body in said receiver body as said forward and rear conical seat surfaces are engaged by said bolt body.

2. The bolt action for a firearm as claimed in claim 1 wherein said floating bolt handle comprises:

a conical surface at a forward portion thereof for contacting the rear conical seat surfaces of said receiver body, whereby as said handle is rotated to a closed position said bolt body contacts said receiver body at said locking lugs and said forward seat surfaces, and at said handle conical surface and said rear seat surfaces, thereby suspending said bolt body in said receiver body.

3. The bolt action for a firearm as claimed in claim 1 comprising:

said bolt body having a central bore therein and a firing pin shank disposed within said central bore, said bolt body having a firing pin aperture therein at a forward portion thereof for accepting a firing pin therethrough; and a firing pin in contact with said shank, said firing pin and said shank capable of independent movement within the central bore of said bolt body while said bolt body is held suspended in said receiver.

4. The bolt action for a firearm as claimed in claim 3 wherein said firing pin comprises:

a rear surface comprised of a portion of magnetic material whereby said firing pin is movable with respect to the firing pin shank while maintaining contact therewith thereby eliminating the impact between said firing pin and said firing pin mechanism during firing of said bolt action.

5. The bolt action for a firearm as claimed in claim 1 comprising:

said receiver body having a tang at a rear portion thereof, said tang having a t-slot therein; and said bolt body having a cocking piece with a pair of flanges extending therefrom for engaging said t-slot of said receiver body whereby said flanges closely engage said t-slot when said bolt body is inserted into said receiver body thereby preventing bolt body lift during the closing of said bolt under pressure.

6. The bolt action for a firearm as claimed in claim 1 wherein said receiver body comprises:

a plurality bedding pads in a bottom portion thereof, each of said pads having a pair of action screw holes therein for securing said receiver body to a firearm stock, said action screw holes disposed at an angle of less than ninety degrees to a vertical line bisecting said receiver body.

7. The bolt action for a firearm as claimed in claim 6 comprising:

a plurality of bedding pads each having opposed angled surfaces through which said action screw holes are disposed.

8. The bolt action for a firearm as claimed in claim 7 comprising:

a plurality of bedding blocks secured to a firearm stock, said bedding blocks having a central port at a lower portion thereof, and a pair of angled apertures therethrough for permitting action screws to be inserted through said apertures into said receiver body action screw holes, thereby securing said firearm stock to said receiver body.

9. The bolt action for a firearm as claimed in claim 8 comprising:

a plurality of bedding blocks each having opposed angled surfaces through which said angled apertures are disposed, said opposed angled surfaces mating with said opposed angled surfaces of said bedding pads, whereby said surfaces center said receiver body in said stock as said action screws are tightened.

10. The bolt action for a firearm as claimed in claim 6 comprising:

a plurality of bedding blocks secured to a firearm stock, said bedding blocks having a central port at a lower portion thereof, and a pair of angled apertures therethrough for permitting action screws to be inserted through said apertures into said receiver body action screw holes, thereby securing said firearm stock to said receiver body.

11. The bolt action for a firearm as claimed in claim 10 wherein said plurality of bedding blocks comprise:

a pair of opposed angled surfaces through which said angled apertures are disposed.

12. The bolt action for a firearm as claimed in claim 1 comprising:

a recoil lug extending radially outwardly from and around a forward portion of said receiver body both for contacting a surface of a stock of said firearm and thereby transferring recoil energy in line with a centerline of said barrel.

13. The bolt action for a firearm as claimed in claim 1 comprising:

a recoil lug at a forward portion of said receiver body having a plurality of grooves in a side portion thereof, said grooves extending up to a centerline of said firearm barrel bore thereby transferring recoil energy in line with a centerline of said barrel.

* * * * *